United States Patent [19]

Green et al.

[11] 4,145,274

[45] Mar. 20, 1979

[54] PYROLYSIS WITH STAGED RECOVERY

[75] Inventors: Norman W. Green, Upland, Calif.; Kandaswamy Duraiswamy, Sterling, Va.; Robert E. Lumpkin; Bruce L. Winter, both of Claremont, Calif.

[73] Assignee: Occidental Petroleum Corporation, Los Angeles, Calif.

[21] Appl. No.: 794,136

[22] Filed: May 5, 1977

Related U.S. Application Data

[63] Continuation of Ser. No. 699,991, Jun. 25, 1976, abandoned.

[51] Int. Cl.[2] ..... C10G 1/00; C10B 49/16; C10B 55/08

[52] U.S. Cl. ..... 208/8; 48/210; 201/4; 201/8; 201/12; 201/17; 201/22; 201/25; 201/28; 201/30; 201/32; 201/42; 202/99; 208/11 R

[58] Field of Search ..... 201/3, 4, 7, 8, 9, 10, 201/12, 17, 20, 21, 22, 25, 28, 29, 30, 32, 34, 36, 37, 42, 33; 202/99, 108, 120, 121; 259/4 R, 18, 36; 208/8, 11 R; 48/210 (U.S. only)

[56] References Cited

U.S. PATENT DOCUMENTS

| | | | |
|---|---|---|---|
| 1,954,352 | 4/1934 | Dornbrook et al. | 202/108 |
| 2,582,712 | 1/1952 | Howard | 201/31 X |
| 2,707,702 | 5/1955 | Watson | 201/12 X |
| 2,723,951 | 11/1955 | Minet | 201/28 X |
| 2,935,466 | 5/1960 | Schoenmakers | 23/288 S X |
| 3,655,518 | 4/1972 | Schmalfeld et al. | 201/12 X |
| 3,717,438 | 2/1973 | Schmalfeld et al. | 23/277 R X |
| 3,846,096 | 11/1974 | Wallan et al. | 48/210 X |
| 3,855,070 | 12/1974 | Squires | 201/31 X |
| 3,867,110 | 2/1975 | Schora et al. | 201/9 X |
| 3,876,392 | 4/1975 | Kalina et al. | 48/210 |
| 3,891,402 | 6/1975 | Nahas et al. | 48/197 R |
| 3,904,549 | 9/1975 | Barton et al. | 201/12 X |

FOREIGN PATENT DOCUMENTS

| | | |
|---|---|---|
| 520801 | 1/1956 | Canada. |
| 2509352 | 9/1975 | Fed. Rep. of Germany. |
| 75/1163 | 2/1976 | South Africa. |
| 1398858 | 6/1975 | United Kingdom. |

*Primary Examiner*—Joseph Scovronek
*Attorney, Agent, or Firm*—Christie, Parker & Hale

[57] ABSTRACT

In a continuous process for recovery of values contained in a solid carbonaceous material, the carbonaceous material is comminuted and then subjected to flash pyrolysis in the presence of a particulate heat source fed over an overflow weir to form a pyrolysis product stream containing a carbon containing solid residue and volatilized hydrocarbons. After the carbon containing solid residue is separated from the pyrolysis product stream, values are obtained by condensing volatilized hydrocarbons. The particulate source of heat is formed by oxidizing carbon in the solid residue.

44 Claims, 11 Drawing Figures

PYROLYSIS WITH STAGED RECOVERY

This is a continuation of application Ser. No. 699,991, filed June 25, 1976, now abandoned.

BACKGROUND OF THE INVENTION

Fluid fossil fuels such as oil and natural gas are becoming scarce as these fuels are consumed by a world whose population is continually growing. Also, the supply of oil to industrialized countries has been and could be again interrupted. For these reasons, there is a need for a method for converting solid carbonaceous materials such as coal, oil shale, and the organic portion of solid waste to liquid and gaseous hydrocarbons.

SUMMARY OF THE INVENTION

This invention is for a continuous process for recovery of the values contained in solid carbonaceous materials, and especially in agglomerative coals. In this process a particulate feed stream containing solid carbonaceous material particles of a size less than about 1000 microns in diameter, and preferably less than about 250 microns in diameter in the case of an agglomerative coal, is provided. The feed stream is subjected to flash pyrolysis by transporting the feed stream contained in a carrier gas which is substantially nondeleteriously reactive with respect to products of pyrolysis to a solids feed inlet of a descending flow pyrolysis reactor. The pyrolysis reactor contains a substantially vertically oriented pyrolysis zone operated at a temperature above about 600° F. In addition, a particulate source of heat is fed at a temperature above the pyrolysis temperature to a substantially vertically oriented chamber surrounding the upper portion of the pyrolysis reactor. The inner peripheral wall of the chamber forms an overflow weir to the vertically oriented mixing region of the pyrolysis reactor. The particulate heat source is maintained in a fluidized state in the chamber by an aerating gas which also is substantially nondeleteriously reactive with respect to the products of pyrolysis. The particulate source of heat is discharged over the weir and downwardly into the mixing region at a rate sufficient to maintain the pyrolysis zone at the pyrolysis temperature.

The solid carbonaceous material feed stream and carrier gas are injected from the solids feed inlet into the mixing region to form a resultant turbulent mixture of the particulate source of heat, the carbonaceous material particles and the carrier gas. This resultant turbulent mixture is passed downwardly from the mixing zone to the pyrolysis zone of the pyrolysis reactor. In the pyrolysis zone the carbonaceous material feed is pyrolyzed to yield a pyrolysis product stream containing as solids, the particulate source of heat and a carbon containing solid residue of the carbonaceous material, and a vapor mixture of carrier gas and pyrolytic vapors comprising hydrocarbons. The pyrolysis product stream is then passed to a separation zone to separate at least the bulk of the solids from the vapor mixture.

The particulate source of heat is formed by transporting the separated particulate solids from the separation zone to at least one oxidation zone where a portion of the carbon in the solids is oxidized in the presence of an amount of free oxygen at least sufficient to raise the solids to a temperature sufficient for introduction to the pyrolysis zone. Preferably, oxidation occurs in two stages, the first involved during transport of the solids, and the second in a communicating oxidation stage. Of the total free oxygen fed, the amount of free oxygen introduced to the second stage is at least 50% of the molar amount of carbon monoxide entering the second stage.

The formed particulate source of heat and the gas present in the second oxidation stage are passed from the second oxidation stage to a second separation zone such as one or more cyclone separators. In the second separation zone the particulate source of heat is separated from the gases for feed to the chamber surrounding the upper portion of the pyrolysis reactor.

It is preferred that the second oxidation stage and the first cyclone separation stage of the second cyclone separation zone be the same vessel, i.e., a cyclone oxidation-separation zone. This minimizes formation of carbon monoxide by allowing quick removal of the formed particulate source of heat from its gaseous combustion products, thereby increasing the thermal efficiency of the process.

In the process of this invention, short reaction time and low temperatures in the pyrolysis reaction zone enhance formation of the middle distillate hydrocarbons, i.e., hydrocarbons in the range of $C_5$ hydrocarbons to hydrocarbons having an end point of 950° F. As a consequence, it is preferred to conduct pyrolysis so that the residence time of the carrier gas in the pyrolysis section of the pyrolysis reactor and the first separator is less than about 5 seconds, and more preferably from about 0.1 to about 3 seconds. It also is preferred that pyrolysis be conducted at a temperature from about 900° to 1400° F. To achieve pyrolysis the solid particulate source of heat generally is introduced at a temperature from about 100° to about 500° F. higher than the pyrolysis temperature to be achieved. The weight ratio of the particulate source of heat to the carbonaceous feed ranges from about 2 to about 20:1.

To provide turbulence to obtain rapid heat transfer from the particulate source of heat to the carbonaceous material, the turbulent mixture preferably has a solids content ranging from about 0.1 to about 10% by volume based upon the total volume of the stream.

The process of this invention has many advantages. Among these is improved process control because of a reservoir of the particulate source of heat behind the weir which dampens the effect of minor system upsets. Another advantage is that agglomerative coals can be processed with the process and apparatus of this invention because the turbulent flow in the mixing region continuously scours buildups of coal from the reactor walls. In addition, high yield of the valuable middle distillates can be obtained by operating the process under the preferred conditions.

Another advantage of the method and apparatus of this invention is that high thermal efficiencies are achieved because carbon monoxide formed by the transport gas reacting with carbon in the carbon containing residue in the first oxidation stage is oxidized in the second oxidation stage.

This invention also contemplates recovering hydrocarbon values from the vapor mixture. This is effected by progressively cooling the vapor mixture by directly contacting the vapor mixture with progressively cooler liquid coolant streams containing condensate of the vapor mixture.

These and other features, aspects and advantages of the invention will become apparent with respect to the following drawings, detailed description of the invention, and appended claims.

DRAWINGS

FIG. 1 schematically shows products obtained from pyrolysis of solid carbonaceous materials;

FIG. 2 schematically illustrates the overall process of this invention;

DETAILED DESCRIPTION

According to the present invention there is provided a totally integrated system for economical recovery of values from solid carbonaceous materials, and particularly from agglomerative as well as nonagglomerative coals. The system consists of the following major operations: a preparation operation, a pyrolysis operation, a recovery operation, and a gas cleanup operation.

First, definitions are presented followed by a description in general terms of the overall operations. Next, features of each major operation are detailed.

Figure 3:
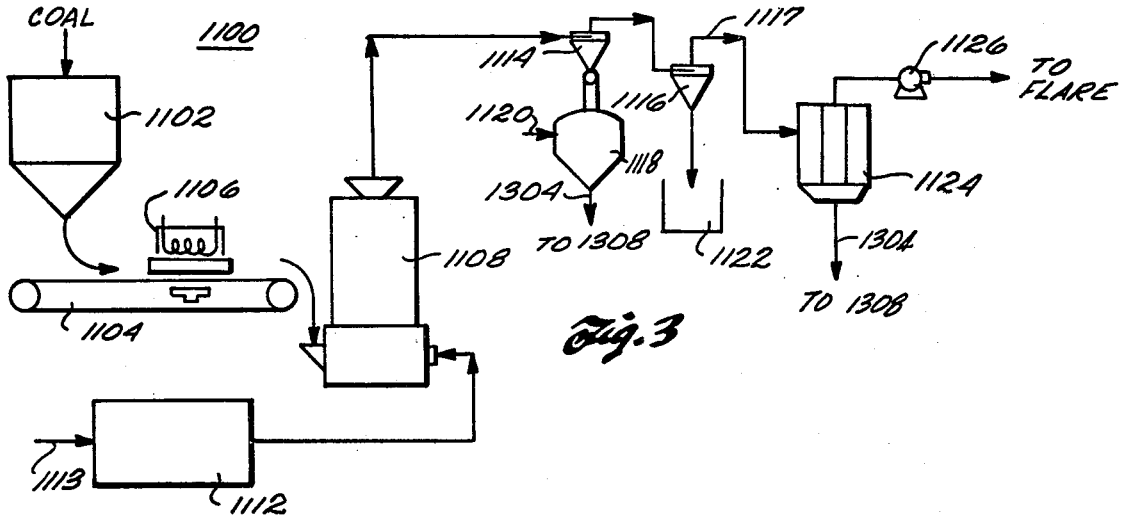
FIG. 3 illustrates the details of a first preparation operation.
Figure 4:
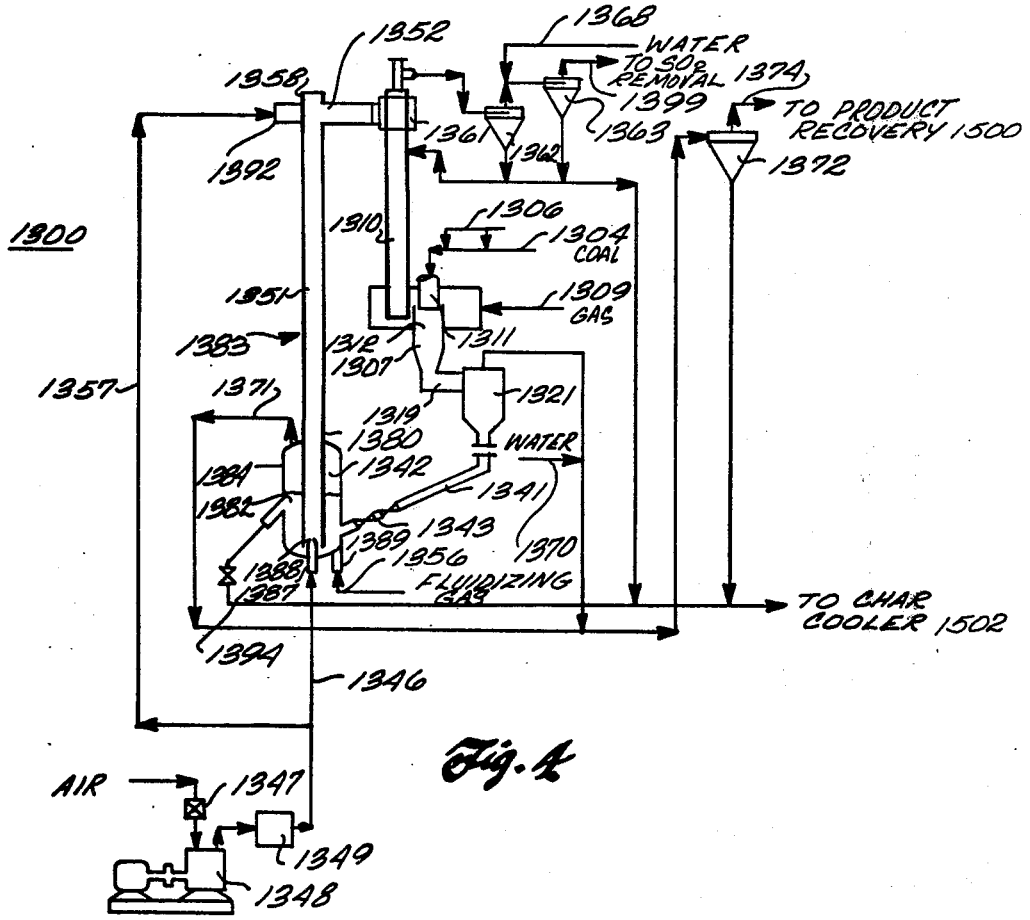
FIG. 4 illustrates a first pyrolysis operation.
Figure 5:
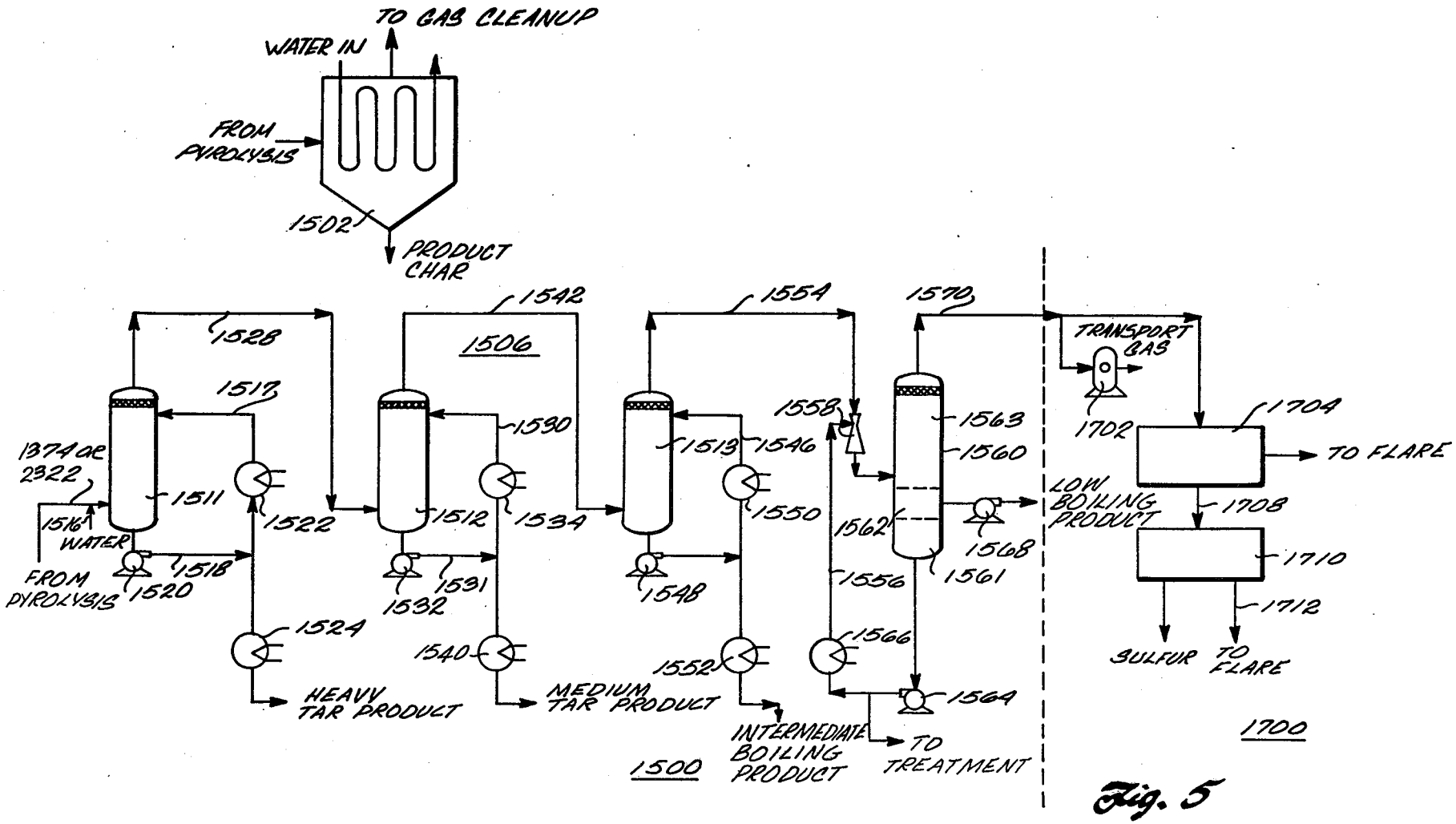
FIG. 5 depicts the details of a product recovery operation and a gas cleanup operation.

The attached drawings are to be considered jointly and where indicated sequentially for understanding the sequence of operations which comprises the invention. Although the features of each may be interchanged, the operations shown in FIGS. 3, 4, and 5 are sequentially joined to yield one version of the overall process.

A. Definitions

This section presents definitions useful in understanding the process of the present invention.

As used herein and in conjunction with the processing operations described, the term "comminution" refers to any physical act of size reduction, including, but not limited to chopping, crushing, and grinding by suitable machinery.

Figure 1:
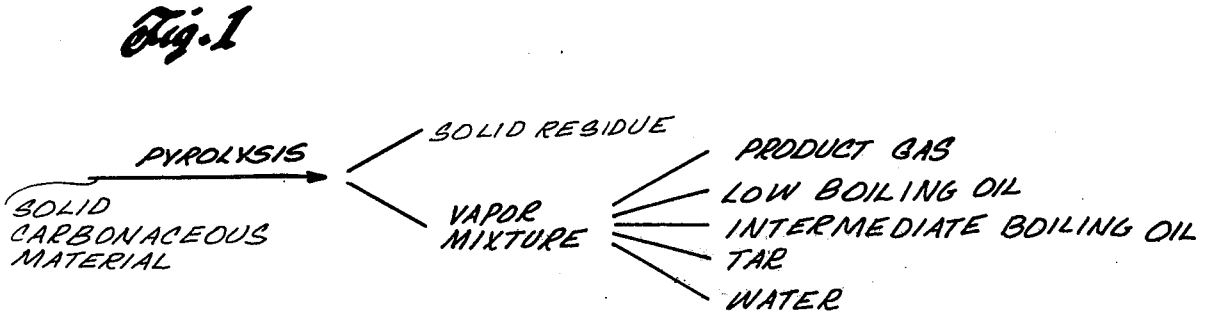

The terms defined in this section referring to effluent streams from a pyrolysis reaction zone can best be understood by reference to FIG. 1, which shows the relationship between the various streams. When a solid carbonaceous material is pyrolyzed there is formed a mixture of a carbon containing solid residue of pyrolysis and a vapor mixture. When coal is the carbonaceous material, char is the carbon containing residue. "Char" is a combustible carbonaceous residue remaining after thermal distillation of volatiles from coal with attendant thermal cracking of the volatilized hydrocarbons. The vapor mixture contains "volatilized hydrocarbons," water, and nonhydrocarbon gases such as carbon monoxide and hydrogen resulting from the pyrolysis of coal.

By the term "volatilized hydrocarbons" there is meant the gaseous hydrocarbons produced by pyrolysis of a solid carbonaceous material. In general these consist of condensible hydrocarbons in vapor form which may be recovered by simply contacting the volatilized hydrocarbons with condensation means, and noncondensible hydrocarbons such as methane which are not recoverable by ordinary condensation means which comprise a "product gas" stream. Nonhydrocarbon gases such as carbon dioxide, carbon monoxide, hydrogen, ammonia, and hydrogen sulfide end up in the "product gas," from which they can be removed by means such as chemical scrubbing.

Water is recovered from the vapor mixture while the condensible volatilized hydrocarbons are separated into three fractions, a "low boiling" fraction which typically consists of $C_4$ hydrocarbons up to constituents having a boiling point up to about 350° F., an intermediate boiling fraction containing constituents having a boiling point in the range of from about 250° to about 650° F., and a viscous "tar" fraction containing constituents having a boiling point greater than about 550° F. Some overlap in these boiling points is inevitable with conventional separation apparatuses. All boiling points presented herein are at atmospheric pressure.

A nondeleteriously reactive carrier or transport gas typically is used to carry coal particles to a pyrolysis reactor. By a "nondeleteriously reactive" gas there is meant a gas which is essentially free of free oxygen, although the constituents of the gas may react with pyrolysis products to upgrade their value. To be avoided are constituents which degrade pyrolysis products.

B. Overall Operations

Figure 2:
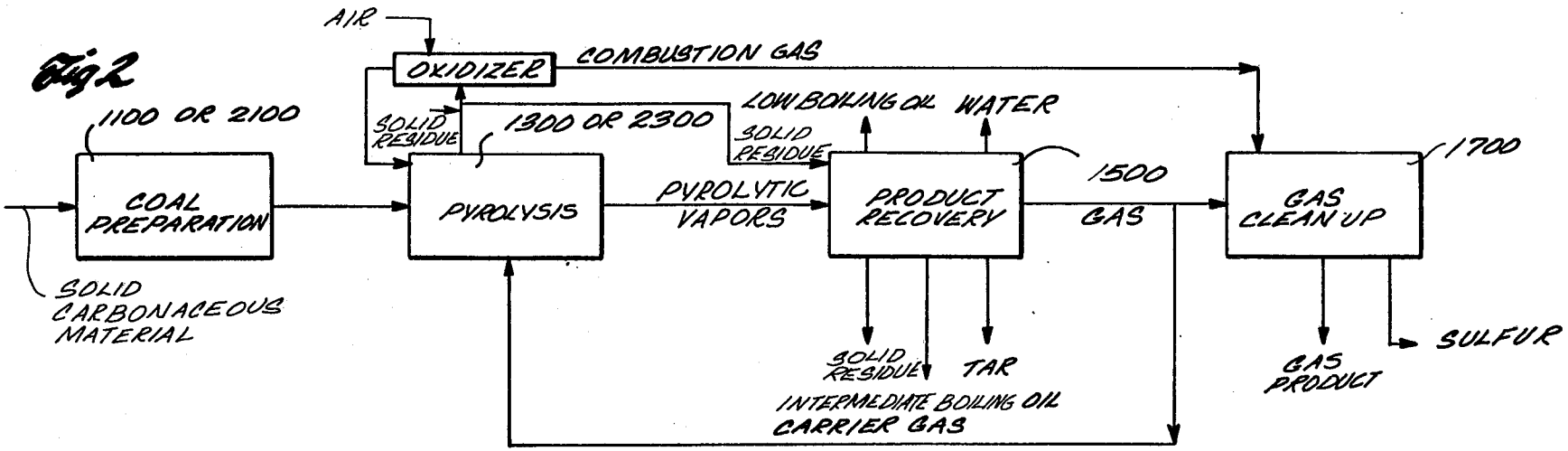

FIG. 2 schematically shows the overall process for recovery of values from solid carbonaceous materials.

The solid carbonaceous materials from which values may be recovered in accordance with this invention include uintaite, tar sands, oil shale, the organic portion of solid waste, particularly coal, in which terms this invention is described, and more particularly agglomerative coals, and the like, as well as mixtures thereof. All the various types of coal or coal like substances can be pyrolyzed. These include anthracite coal, bituminous coal, subbituminous coal, lignite, peat, and the like.

A solid carbonaceous material is introduced to a preparation operation 1100 (FIG. 3) or 2100 (FIG. 6) where it is initially comminuted to a particle size less than about 1000 microns, and in the case of an agglomerative coal, preferably to less than about 250 microns. Production of fines less than about 10 microns is minimized, and fines less than about 10 microns in diameter are separated from the comminuted carbonaceous material to minimize carryover of the particulate residue of pyrolysis into the pyrolysis hydrocarbon product.

The solid carbonaceous material can optionally be fully dried or partially dried to leave some moisture in it for the generation of steam. The solid carbonaceous material is preferably partially dried to remove at least surface moisture to avoid the expenditure of heat energy for heating and vaporizing water in the pyrolysis zone.

Next, in a pyrolysis operation 1300 (FIG. 4) or 2300 (FIG. 6) the solid carbonaceous material feed stream, a carrier gas which is substantially nondeleteriously reactive with respect to pyrolysis products, and a particulate heat source are combined under turbulent flow conditions in a flash pyrolysis zone. The flash pyrolysis zone is maintained at a temperature above about 600° F. by the flow of the particulate heat source therethrough. The pyrolysis product stream from the pyrolysis zone includes carbon containing solid residue and a vapor mixture containing volatilized hydrocarbons. The carbon containing solid residue is separated from the pyrolytic vapor and at least a portion of the separated solids is subjected to at least partial oxidation in the presence of a gas stream containing free oxygen to form the particulate source of heat for the pyrolysis operation and gaseous combustion products. Excess solid residue beyond what is needed to form the particulate source of heat is withdrawn as product.

In a product recovery operation 1500 (FIG. 5) values are separated from the pyrolysis product stream. This is effected by condensing volatilized hydrocarbons as a low boiling fraction, an intermediate boiling fraction and tar from the vapor mixture. Water is decanted from the low boiling fraction.

Gases not condensed in the product recovery operation as well as the char combustion products are cleaned up in a gas cleanup operation 1700 (FIG. 5) where sulfur compounds may be scrubbed from the gas. Carbon dioxide may also be scrubbed from the gas. A portion of the gas, either before or after cleaning, is recycled to the pyrolysis operation as a carrier gas. A portion containing uncondensed hydrocarbons can be recovered as a valuable gas product stream.

C. Preparation Operation

FIG. 3 illustrates the details of preparation operation 1100. There is provided a feed bin 1102 to receive feed coal. The coal is dumped from the feed bin onto a weight scale conveyor 1104 which continuously carries the coal through a magnetic separator 1106 which removes from the coal feed magnetic particles such as loose metal parts which may damage downstream equipment. The weight scale conveyor 1104 senses the weight of the coal upon it, and automatically varies the speed of the conveyor to control the amount of the coal fed to the next stage of the process.

The conveyor 1104 dumps the coal into a single pass combination pulverizer-dryer stage 1108 such as a Raymond ball mill. The pulverizer-dryer 1108 comminutes the feed coal to a particle size of less than about 1000 microns to present a large surface to volume ratio to obtain rapid heating of the coal in the pyrolysis zone. Two comminution stages are required to comminute the coal to a particle size less than 1000 microns. Industrial grinding equipment is available which contains mechanically linked crushing and pulverizing stages. For an agglomerative coal, preferably the coal is comminuted to a particle size at least less than about 250 microns because agglomerative coals are well known to plasticize and agglutinate at relatively low temperatures, i.e., 400° to 850° F. An agglomerative coal should be rapidly heated through the plastic state before it strikes the walls of a pyrolysis reactor to prevent caking on the reactor walls. Since the rate at which a coal particle can be heated increases as particle size decreases, it is important that an agglomerative coal be comminuted to 250 microns or less, depending on the size and configuration of the pyrolysis reactor, so that substantially all the coal particles are not tacky by the time the coal particles strike a reactor wall. For example, when a bituminous high volatile C coal which agglomerates at temperatures above about 500° F. is pyrolyzed in a 10 inch diameter pyrolysis reactor of the design shown in FIG. 9 and described below at a temperature of 1075° F., the coal is comminuted to a size less than 75 microns in diameter to prevent caking on the reactor walls. Coal particles larger than 75 microns in diameter would strike the reactor walls before passing through the plastic state.

Hot gas is blown by a heater-blower 1112 through the pulverizer-dryer 1108 to reduce the moisture content of the feed coal by removing at least the surface moisture so that the energy supplied to the pyrolysis reactor is not diverted into vaporizing water in the coal feed. Preferably some moisture is left in the coal since this increases the yield from the pyrolysis reaction. For example, high hydrocarbon product yield is obtained by leaving about 15% by weight water in subbituminous coal. Air, flue gas, or the effluent gas from a flare can be used as the gas stream 1113 heated in the heater-blower 1112. The hot gas carries the comminuted coal feed into a classifier such as a first stage feed coal cyclone 1114.

Generally, it is preferred to comminute the coal to a small size for rapid heating in a pyrolysis reactor. However, as the average size of the coal particles is decreased and as the limit on the largest particle size is lowered, more fines are produced.

It is important to minimize the amount of fine particles in the coal fed to the pyrolysis zone because fine coal particles have a tendency to be carried into and contaminate the liquid hydrocarbon products.

One method of minimizing the fines content of the coal feed stream is by removing fines from the coal feed stream by passing the coal feed stream to a cyclone separation zone comprising at least two cyclone stages in series. The bulk of the coal feed stream is separated in a first cyclone separation stage of the cyclone separation zone from a fine fraction of the coal feed stream which preferably contains substantially all of the coal feed stream smaller than about 10 microns in diameter. The stream separated in the first cyclone separation stage is for introduction to a pyrolysis zone. The fine fraction is recovered in the remaining cyclone separation stages of the cyclone separation zone.

This method is used in the process shown in FIG. 3 where in a first stage coal feed cyclone 1114 the larger coal particles are separated and dropped into a coal feed tank storage bin 1118. A portion of the fines, and preferably substantially all of the fines less than about 10 microns in diameter, are removed from the comminuted coal in this first stage cyclone and are carried overhead to a second stage feed cyclone 1116 along with the carrier flue gas.

In the second stage feed coal cyclone 1116, at least a portion of the fine coal particles from the feed coal in the first stage feed coal cyclone 1114 are separated from the carrier gas stream and collected in a receptacle 1122 for use as fuel. The carrier gas stream 1117 from the second stage feed coal cyclone 1116 is fed to a bag house 1124 where any entrained coal particles are removed from the gas stream. The gas is then blown by an exhaust fan 1126 to a flare stage (not shown) where combustible constituents are oxidized and then vented to the atmosphere.

In the case of agglomerative coal, it is preferred that the coal particles be maintained at a temperature below about 300° F. in the coal feed tank 1118 to prevent their agglomeration.

In order to prevent the danger of a possible explosion in the pyrolysis reactor and to prevent the exposure of coal particles to oxygen sources to prevent oxidizing of the coal, since such exposure has a deleterious effect on yields from the process, an inert gas which is non-deleteriously reactive with respect to pyrolysis products is fed into the coal feed bin via line 1120 to blanket the coal in the feed bin. This gas also aerates the coal to allow it to flow from the coal feed bin 1118 to the pyrolysis zone.

Figure 6:
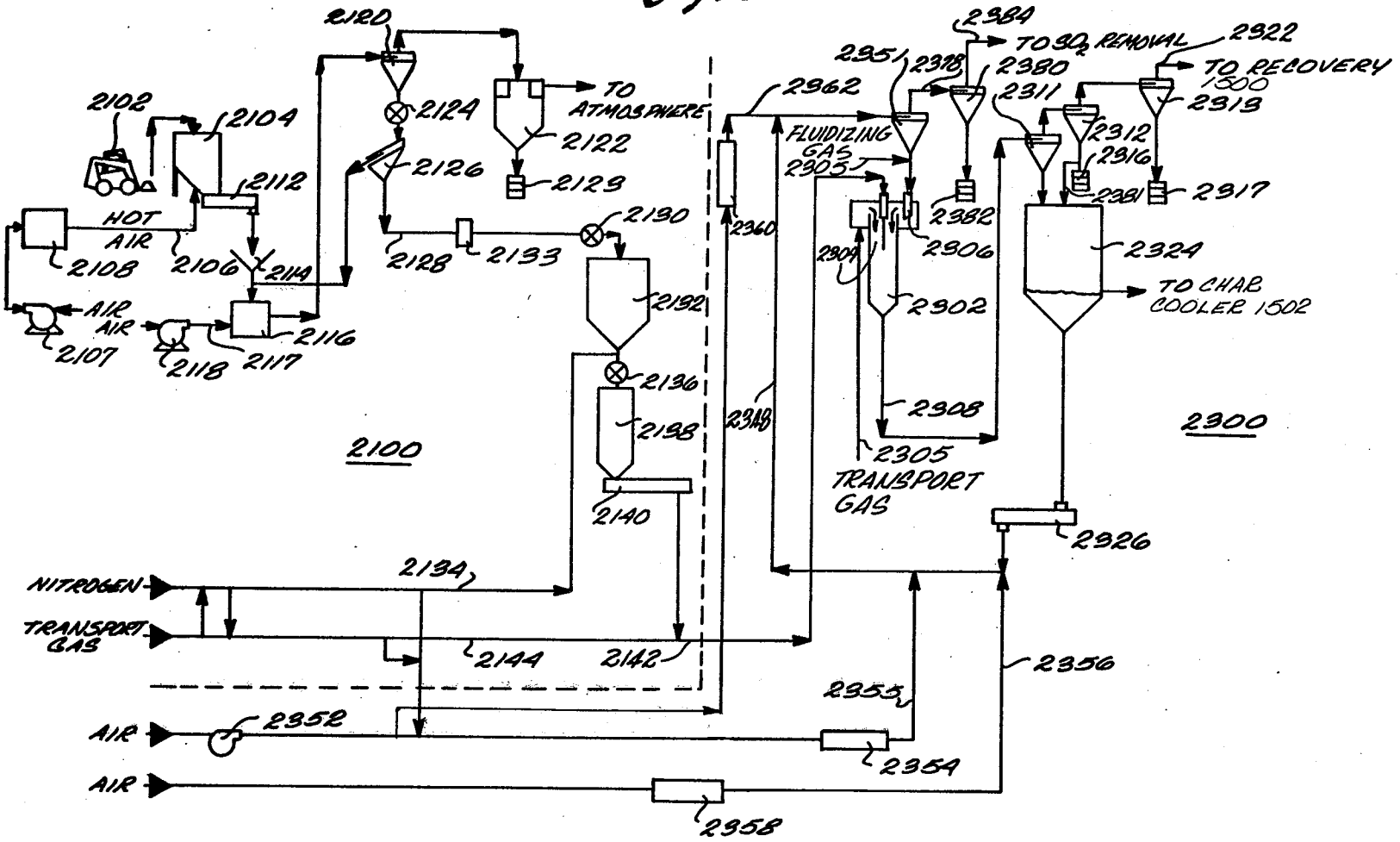
FIG. 6 illustrates details of a second preparation operation and a second pyrolysis operation.

To the left of the dotted line in FIG. 6 the details of coal preparation operation 2100 are shown. There is provided a coal storage and transfer area where coal transport units 2102 are continuously employed to deposit coal for processing for the recovery of the values contained therein. The coal is dumped into a raw coal bin 2104. The coal is fluidized and dried in the bin 2104 by a flue gas stream from the gas cleanup operation or by a hot air stream 2106 obtained by blowing air with a blower 2107 through a heater 2108. Preferably the coal is dried to the same moisture content as it is dried in the 1100 coal preparation operation described above.

The coal is dumped from the bin 2104 onto a conveyor 2112 which carries the coal to a crusher 2114 and thence to a pulverizer stage 2116. Preferably the pulverizer is operated so that a portion of the coal is comminuted to a size above the upper target size in a single pass through the pulverizer to reduce fines formation and reduce energy consumption during comminution. For example, when the upper limit on the particle size of the coal is 75 microns the pulverizer is operated to leave at least 5% by weight of the coal at a particle size greater than about 75 microns in in diameter. This is effected by comminuting the coal so that from about 70 to about 95% and preferably from about 80 to about 95% of the coal by weight is comminuted to a size less than 75 microns in diameter. It has been found that if all the coal is reduced to a size less than 75 microns in a single pass through the pulverizer 2116, excessive fines are produced, which subsequently must be withdrawn to prevent fine coal particles from being carried into the liquid hydrocarbon products of the coal.

The coal is transported from the pulverizer 2116 by a flue gas stream or an air stream 2117 produced by a compressor 2118 to a pulverized coal feed classifier such as a cyclone 2120 where a portion of the fines less than about 10 microns in diameter are carried overhead by the air stream to a bag house 2112 where the fines are separated from the transport gas which is vented to the atmosphere. The fines are collected in a container 2123 and can be used as boiler feed. The larger coal particles pass from the cyclone 2120 via solids conveyor means such as a rotary lock valve 2124 into a mechanical classifier such as a vibrating screen 2126. The rotary lock valve prevents the air in the coal comminution system from entering the comminuted coal storage area, and possibly the pyrolysis reactor where an explosion could occur. The screen 2126 separates oversized coal particles greater than the upper limit on the particle size of the coal from the remainder of the comminuted coal. The oversized coal is recycled to the pulverizer 2116. The remainder of the coal, which has a particle size less than the upper limit on the particle size and greater than about 10 microns drops via line 2128 into a conveyor such as a bucket or elevator conveyor or a rotary valve 2130 which carries the coal to a pulverized coal feed bin 2132. A sample point 2133 can be positioned in line 2128 to monitor the particle size distribution of the pulverized coal so that the operation of the pulverizer 2116 can be adjusted to prevent fines from entering the coal feed bin.

The pulverized coal storage bin 2132 preferably is maintained under an atmosphere free of oxygen by bleeding in a gas such as nitrogen or transport gas via line 2134 to prevent oxidation of the coal. Oxidation of coal has a deleterious effect on yields from the process, and leakage of oxygen into the pyrolysis reaction zone can result in an explosion and adversely effect process yields. From the pulverized coal feed bin 2132 the coal is transported via solids conveyor means such as a rotary valve 2136 into a feeder hopper 2138 utilized to prevent upsets in the coal preparation operation from affecting the pyrolysis operation. The feeder hopper 2138 also preferably is maintained under an oxygen free atmosphere. Preferably during the entire coal preparation operation the coal is not exposed to temperatures above about 300° F. to prevent agglomeration of the coal particles when an agglomerative type coal is being processed.

The comminuted coal in the feeder hopper 2138 is fed at a desired rate by a feeder such as a gravimetric feeder or a screw feeder 2140 into the reactor feed transport line 2142. The coal feed is carried by a transport gas stream 2144 to the pyrolysis reactor 2302 in the pyrolysis operation. The transport gas is nondeleteriously reactive with respect to pyrolysis products. The transport gas can be a portion of the gas generated in the pyrolysis reactor 2302 and recovered in the product recovery operation 1500. Other nondeleteriously reactive gases such as nitrogen and steam may also be used.

D. Pyrolysis Operation

FIG. 4 depicts in detail pyrolysis operation 1300. In this operation the coal is pyrolyzed to form char and gases comprising volatilized hydrocarbons.

With reference to FIG. 4, the comminuted dried coal in the coal feed tank 1124 is fed into line 1304 and carried by a transport gas stream 1306 into a pyrolysis reaction zone 1307. The transport gas preferably is nondeleteriously reactive with respect to pyrolysis products.

At an inlet mixing region 1312 of the pyrolysis reaction zone 1307, the coal feed stream 1304 is combined with a gas which is nondeleteriously reactive with respect to pyrolysis products in line 1309 and a particulate heat source in duct or standpipe 1310 to form a pyrolysis feed stream. The particulate source of heat serves to prevent agglomeration and to provide at least a portion of the heat required for pyrolysis. The selection of the mass ratio of the hot particulate char to the coal particules depends upon the heat transfer requisites of the system, the tendency of the coal particles to agglomerate, and the amount of the heat of pyrolysis which is supplied by the carrier gas. The temperature, flow rate, and residence time in the reactor depend upon the particular system undergoing pyrolysis. The heat source employed may be solids provided external to the process such as sand. Preferably the heat source is the solid product resulting from pyrolysis of the carbonaceous material, such as char or coke, or, in the instance of municipal solid waste, the glass-like inorganic residue resulting from the decarbonization of the solid residue of pyrolysis. The preferred heat source when coal is the solid carbonaceous material is char obtained from devolatilization of coal in the pyrolysis reactor.

The pyrolysis reaction zone 1307 is operated, depending upon the temperature and the nature of the particulate heat source, at a temperature of from between about 600° F. and the introduction temperature of the particulate heat source. The reactor temperature is sustained essentially by the particulate heat source.

In the pyrolysis reactor, heat transfer occurs primarily by a solid-to-gas-to-solid convective mechanism with some solid-to-solid radiative and conductive heat transfer occurring.

The transport gas for both the coal and the particulate heat source can be the gas resulting from the pyrolysis of the coal either before or after condensible hydrocarbons are recovered and compounds such as hydrogen sulfide are scrubbed from the gas. The carrier gas can be synthesis gas, especially a hydrogen enriched synthesis gas. For maximum utilization of the particulate heat source, the transport gas for the particulate heat source should approach the particulate heat source's temperature.

The operating pressure of the pyrolysis reactor is usually above atmospheric pressure. As the pressure is increased, compression of the carrier gas and the volatilized hydrocarbons results. This allows use of lower volume downstream separation equipment.

The pyrolysis reaction zone is operated under the conditions described in U.S. Pat. No. 3,736,233, issued to Sass et al and assigned to the assignee of this invention. According to the method of this patent, the coal feed stream 1304, the particulate char 1310, and the carrier gas stream 1309 which is nondeleteriously reactive with respect to pyrolysis products are combined as a pyrolysis feed stream at the inlet mixing region 1312 of the pyrolysis reaction zone 1307. Generally high solids content in the pyrolysis feed stream is desired to minimize equipment size and cost. However, preferably the pyrolysis feed stream contains sufficient carrier gas that the feed stream has a low solids content ranging from about 0.1 to 10% by volume based on the total volume of the stream to provide turbulence for rapid heating of the coal and to dilute the coal particles and help prevent them from agglomerating, particularly when processing agglomerative coals. Rapid heating results in high yields and prevents agglomeration of agglomerative coals. The solids in the pyrolysis feed stream are divided between coal and char with a char to coal weight ratio of from about 2 to about 20:1. The particulate char has a temperature consonant with the requirements of the pyrolysis zone, depending on the coal and carrier gas temperatures, and the mass ratios of the coal, char and carrier gas. At the above char to coal ratios, the temperature of the particulate char is typically about 100° to about 500° F. higher than the pyrolysis zone temperature.

The temperature in the reaction zone is from at least about 600° F. to about 2000° F. It has been found that the type of product and total yield of product are higher dependent upon the temperature in the reaction zone. As the temperature in the reaction zone increases above about 1400° F. the volatilized hydrocarbons from the pyrolysis reaction contain increasing amounts of noncondensible product gas. Preferably for liquification the particulate coal is heated to a temperature from about 900° F. to about 1400° F., and optimumly to about 1075° F. to produce high yields of volatilized hydrocarbons containing a high percentage of valuable middle distillates. Middle distillates are the middle boiling hydrocarbons, i.e., $C_5$ hydrocarbon to hydrocarbons having an end point of about 950° F. These hydrocarbons are useful for the production of gasoline, diesel fuel, heating fuel, and the like. The maximum temperature in the pyrolysis reactor is limited by the temperature at which the inorganic portion of the source of heat or the carbonaceous material softens with resultant fusion or slag formation. Since the particulate source of heat is normally at a higher temperature than the carbonaceous material, its softening temperature is usually the limiting factor. A pyrolysis temperature of 2000° F. is about the maximum that can be achieved without slag formation.

The pyrolysis time in the reaction zone depends upon a variety of factors such as the temperatures of the components, nature of the coal feed, etc. The residence time in the reaction zone preferably is less than about 5 seconds, and more preferably from about 0.1 to about 3 seconds to maximize the yield of volatilized hydrocarbons, with longer residence times at lower pyrolysis temperatures. Longer pyrolysis times can lead to cracking of the volatilized hydrocarbon produced during pyrolysis, with reduced yield of condensible hydrocarbons.

As used herein, "pyrolysis time" means the time from when the coal contacts the particulate source of heat until the pyrolytic vapors produced by pyrolysis are separated from the spent particulate source of heat. A convenient measure of pyrolysis time is the average residence time of the carrier gas in the pyrolysis section of the pyrolysis reactor and the cyclone separators downstream of the reactor. Sufficient pyrolysis time must be provided to heat the coal to the pyrolysis temperature.

Apparatuses useful for combining the char and the transportable coal at the reactor inlet are shown in FIGS. 7–10. Using such apparatuses, the char and coal streams are intimately mixed under turbulent flow conditions to ensure efficient pyrolysis reaction and good heat transfer from the hot particulate char to the coal feed stream. These apparatuses are particularly useful for agglomerative coals because a turbulent flow of char allows rapid heating of the coal which prevents buildups of carbonaceous material on the reactor walls.

Figure 7:
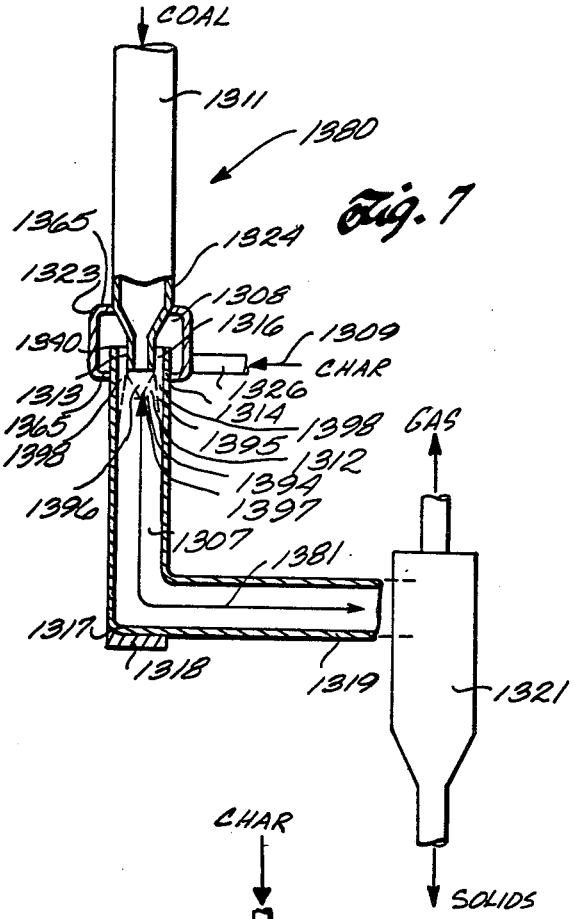
FIGS. 7–10 are elevational views, partly in section, of pyrolysis reactors useful for practicing this invention.

With reference to FIG. 7, the coal feed stream contained in a carrier gas enters a substantially vertically oriented mixing section 1312 of a substantially vertically oriented, descending flow pyrolysis reactor 1380 through a generally upright, annular first inlet 1311, terminating within the mixing section and constricted at its end 1313 to form a nozzle so that a fluid jet is formed thereby. Pyrolysis reactor 1380 is annular and has an upper end 1314, which is an open end of larger diameter than the nozzle 1313, thereby surrounding the nozzle and leaving an annular gap 1316 between the upper end 1314 of the reactor and the nozzle 1313. The reactor has an elbow 1317 in the middle which rests upon a support 1318. The lower end 1319 of the reactor terminates in a reactor product stream cyclone 1321 which separates the gaseous pyrolysis effluents from the solid pyrolysis effluents. An annular fluidizing chamber 1308 is formed by a tubular section 1323 with an annular rim 1365 connected to the first inlet wall 1324 directly above where the wall constricts to form the nozzle 1313 and the upper portion of the reactor. The chamber 1308 surrounds the nozzle 1313 and a portion of the upper end 1314 of the reactor.

A second annular inlet 1326 is generally horizontally connected to the annular fluidizing chamber 1308, therefore receiving a fluidized stream of char. The second inlet 1326 preferably is tangentially positioned with respect to the annular chamber wall to impart a swirl to the incoming stream. Preferably the second annular inlet discharges char into the fluidizing chamber below the top edge 1340 of the reactor so that incoming char builds up in the fluidizing chamber 1308 and is restrained by the weir formed by the upper end 1314 of the reactor to form a solids seal. The char is maintained in a fluidized state in the chamber 1308 by a fluidizing or aerating gas which is substantially nondeleteriously reactive with respect to pyrolysis products fed through inlet 1326 into the chamber. The char in the chamber 1308 passes over the upper end of the overflow weir and through the opening 1316 between the weir and the nozzle into the mixing section of the reactor. The advantage of this weir-like configuration is that an essentially steady flow of fluidized char enters the mixing section because the mass of the char backed up behind the upper end 1314 of the reactor dampens minor fluctuations in the char flow.

In the mixing zone of the pyrolysis reactor, the carbonaceous material contained in the carrier gas is discharged from the nozzle as a fluid jet 1394 expanding towards the reactor wall at an angle of about 20 degrees or less as shown by dotted lines 1395 representing the periphery of the fluid jet. Once the particulate source of heat is inside the mixing section, it falls into the path of the fluid jet 1394 and is entrained thereby, yielding a resultant turbulent mixture of the particulate source of heat, coal feed, and the carrier gas. The jet has a free core region 1396 of coal, as delineated by the V-shaped dotted line 1397 in FIG. 7, extending considerably into the reactor. In the region 1398 between the reactor walls and the fluid jet 1394 there is unentrained particulate source of heat. The particulate source of heat along the periphery 1395 of the fluid jet preferably heats the carbonaceous material in the case of an agglomerative coal through the tacky state before the coal strikes the reactor walls. This mixing of the particulate source of heat with the solid carbonaceous material in the mixing zone initiates heat transfer from the particulate solid source of heat to the coal, causing pyrolysis to occur in a substantially vertically oriented pyrolysis section 1307 of the pyrolysis reactor.

Figure 8:
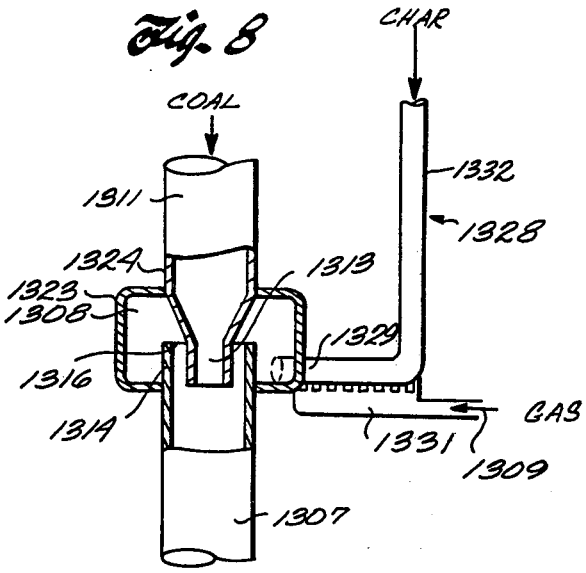

In FIG. 8, the apparatus is the same as that in FIG. 7 except for the second annular inlet 1328 which has a generally horizontal portion 1329 which is equipped with an air slide 1331. The air slide 1331 preferably operates on a transport gas stream 1309 resulting from the pyrolysis of the coal as a fluidizing gas stream. The inlet for the char also has a generally upright portion 1332 through which char is introduced and which communicates with the horizontal portion 1329. Char so vertically introduced is fluidized by the transport gas stream 1309 before its introduction into the fluidizing chamber 1308.

Figure 9:
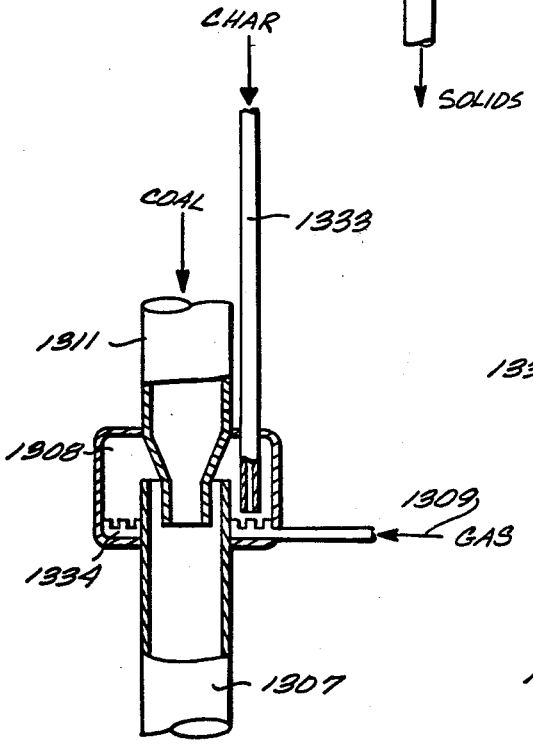

In FIG. 9 the apparatus is the same as in FIG. 7 except that the second annular inlet 1333 for introducing char comes generally vertically instead of horizontally into the fluidizing chamber 1308 and in that a porous bed or plate 1334 has been provided as the bottom of the chamber and has been connected to a source of recycle or carrier gas 1309 adapted to operate thereon in order to fluidize said incoming char by injecting the char with gas. The configuration of this apparatus is preferred and is the same as that of the pyrolysis reactors shown in FIGS. 4 and 6.

Figure 10:
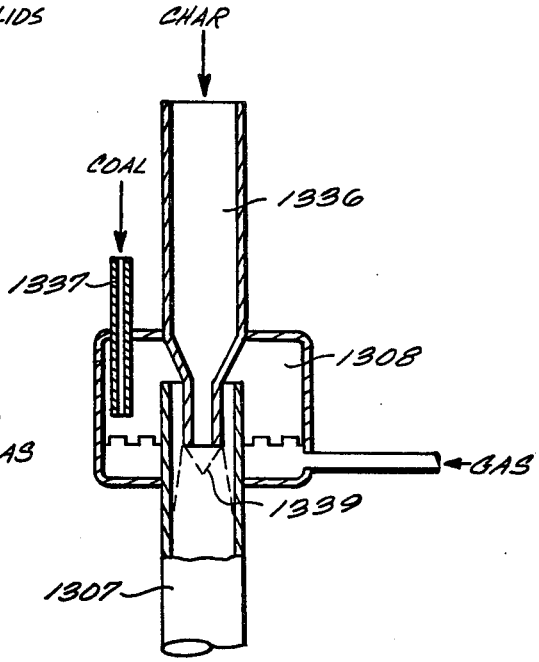

In FIG. 10 the apparatus is similar to that of FIG. 9 except that the char stream is introduced through the first inlet 1336 instead of the coal stream, the coal stream being introduced generally vertically instead to the fluidizing chamber via an upright second inlet 1337. This configuration is suitable only for nonagglomerative coals. The flow paths of the char and coal streams are the opposite of what they are in FIG. 9. The char stream in FIG. 10 is introduced rapidly enough to form a jet stream which acts upon the coal stream as shown by the broken lines 1339, like in FIG. 9.

Similarly, the char may be introduced through the first inlet and a noncaking coal may be introduced through the second inlet in FIGS. 7 and 8.

An advantage of the apparatuses shown in FIGS. 7–9 is that the coal is heated rapidly in the case of agglomerative coals, so that the tacky or sticky phase is thereby gone through rapidly enough to prevent the coal particles from sticking together and plugging the reactor.

Preferably in the apparatuses shown in FIGS. 7–10, the stream of particulate matter, either coal or char, which enters through the second inlet is maintained at a rate of flow less than turbulent and the particulate stream entering via the first inlet is maintained under turbulent flow at a rate sufficiently high that the resulting mixture stream from the contacting of the two inlet streams is under turbulent flow. Turbulent flow results in intimate contact between the coal and char particles, thereby yielding rapid heating of the coal by the char which improves yields. In the case of an agglomerative coal, buildups of tacky coal particles on the reactor walls are prevented by rapid heating of the coal particles due to turbulent flow. As used herein turbulent means the stream has a Reynolds flow index number greater than about 2000. The Reynolds number is based on the carrier gas at operating conditions. Laminar flow in the pyrolysis reactor tends to severely limit the rate of heat transfer within the pyrolysis zone. Process parameters such as the nozzle diameter and mass flow rate of the particulate matter and its carrier gas are varied to maintain the flow rate of the particulate stream entering the first inlet into the turbulent mixing region.

Preferably the nozzle 1313 is protected from wear by being refractory-lined, or it may be lined with any conventional material such as annealed stainless and cast steels, and the like.

The end of the coal feed inlet preferably is cooled as by water when pyrolyzing an agglomerative coal because the inlet can be heated above the point at which the coal becomes tacky due to heat transfer from the particulate source of heat surrounding the end of the solids feed inlet.

Although the Drawings show a solids feed inlet having a nozzle at the end to achieve high inlet velocities into the mixing region, a nozzle at the end of the inlet is not required. Alternatively, the carbonaceous material and its carrier gas can be supplied at a sufficient velocity to the inlet so that the resultant mixture is under turbulent flow without need for a nozzle.

Referring to FIG. 4, the coal feed stream 1304, char from standpipe 1310, and the nondeleteriously reactive carrier gas stream 1309 are combined in the mixing zone 1312 to form a pyrolysis feed stream which is then reacted in the pyrolysis reaction zone 1307 to yield a pyrolysis product stream containing as solids, the particulate source of heat and char as the carbon containing solid product of pyrolysis, and a vapor mixture. The vapor mixture contains carrier gas fed to the pyrolysis reaction zone, and products of pyrolysis such as carbon dioxide, water vapor, hydrogen sulfide and volatilized hydrocarbons.

Hydrogen can be introduced into the pyrolysis reaction zone to upgrade the hydrocarbon products of the coal by hydrogenation of unsaturated carbon-to-carbon beds, denitrogenation, desulfurization, and the like.

In a first stage reactor product stream cyclone 1321 char is separated from the pyrolysis product stream to leave a vapor mixture. The char from the first stage reactor product stream cyclone flows via line 1341 through a slide valve 1343 into fluidized bed 1382 of a char combustion unit 1383. Line 1341 slopes downward, and the vertical drop of line 1341 in combination with the slide valve 1343 is sufficient to prevent any backflow of oxygen containing gas into the reactor 1307.

The particulate source of heat for the pyrolysis reactor is formed by oxidizing at least a portion of the char in an oxidation zone or combustion unit 1383. The combustion unit includes a vessel 1384 containing a fluidized bed 1382 of char around the bottom portion of an open, substantially vertically oriented conduit or riser 1351. There is a gas inlet 1387 for a transport gas 1346 at the base of the vessel which narrows down to form a vertically oriented nozzle 1388 for injection of a gaseous source of oxygen directly upwardly into the riser 1351. The riser 1351 serves as a first oxidation stage or chamber and couples the vessel 1384 to a second oxidation chamber or stage 1352. The fluidized bed 1382 of char is fluidized by a fluidizing gas stream 1356 such as steam entering the chamber through a gas inlet 1389 at the base of the vessel. The fluidizing gas can be distributed throughout the fluidized bed by means of a perforated distributor plate.

There is an inlet 1392 at the upper portion of the riser for introduction of a source of oxygen into the second oxidation chamber 1352. The oxidation chamber which is in the shape of a horizontal duct, is in open communication with the first cyclone 1361 of a cyclone separation zone comprising three char cyclones 1361, 1362, 1363 in series. The separation zone serves to separate the particulate source of heat generated in the combustion unit from any combustion gases produced in the combustion unit. The particulate source of heat is transferred from the first char cyclone separator 1361 to the pyrolysis reactor through the vertically oriented standpipe 1310. The length of the standpipe 1310 is chosen to balance the accumulation of differential pressures throughout the remainder of the system.

The particulate source of heat is formed in the combustion unit 1383. The fluidized bed 1382 is maintained in a fluidized state by an upward flow of the fluidizing gas stream 1356 into the vessel 1384 through the gas inlet 1389. The fluidizing gas can be a gas such as nitrogen which is nonreactive with respect to the char in the vessel, or may contain a portion of the free oxygen required for oxidizing the char to form the particulate source of heat. A transport gas is introduced upwardly through the gas inlet 1387 and nozzle 1388 into the riser 1351.

The transport gas preferably contains free oxygen. Other reactants such as steam which lead to the formation of carbon monoxide also may be present. These include steam and carbon dioxide. When steam is present, hydrogen also is formed.

In the preferred process, the transport gas contains, as indicated, some oxygen to generate a portion of the heat necessary to raise the char to the temperature required for feed to the pyrolysis reactor. However, the amount of oxygen is limited, for if there is too much oxygen in the transport gas, the carbon monoxide generated in the transport line could not be converted to carbon dioxide in the second oxidation stage without introducing so much additional oxygen to the second oxidation stage that the char would be raised to a temperature above the temperature required for feed to the pyrolysis reactor.

With reference to FIG. 4, the transport gas can be hot air stream 1346 obtained by passing air through a filter 1347, compressing the air with a compressor 1348 and heating the compressed air in an air heater 1349 to a temperature from about 800° F. to about 1200° F.

A sufficient supply of this air stream at an appropriate oxygen content is maintained to 1) educt solids from the fluidized bed into the conduit, 2) to oxidize a portion of the carbon in the solids to heat the solids, and 3) to transport the solids and oxidation products, including carbon monoxide, of the solids upwardly through the vertical riser 1351 into the second oxidation stage 1352.

The velocity of the transport gas is maintained sufficiently high to educt solids into the conduit and convey them into the second oxidation stage. For example, when the transport gas contains air as a source of oxygen, a diluent gas essentially free of free oxygen such as nitrogen or flue gas can be combined with the air to provide an oxygen lean carrier gas having sufficient velocity to educt and transport the solids without introducing too much oxygen to generate too much carbon dioxide. By diluting the heated air stream, a carrier gas stream containing less than about 20% oxygen by volume is formed.

The amount of oxygen in the transport gas is controlled to maintain the desired temperature in the riser. This is always less than the stoichiometric amount required to completely oxidize the char. Due to this deficiency of oxygen and the relatively high temperature in the riser, which can range up to about 1100° F. in the case of a pyrolysis reaction zone maintained at about 600° F. to over 2000° F. for a pyrolysis reaction zone maintained at a temperature to enhance gasification, appreciable amounts of carbon monoxide are formed.

Also, as the solids and combustion gases pass upwardly through the riser 1351, carbon dioxide introduced in the transport gas and carbon dioxide formed by oxidation of char tends to react with additional carbon in the char to form carbon monoxide according to the reaction:

$$C + CO_2 \rightarrow 2CO$$

Thus generally, less than about half, and usually from about 20 to about 50% of the oxygen required to form the particulate source of heat is in the transport gas. The remainder of the oxygen required is introduced into the second oxidation stage to oxidize the carbon monoxide from the riser to carbon dioxide.

The configuration of the combustion unit shown in FIG. 4 and described above has many advantages. Among these is instant ignition of the solids in the fluidized bed due to the well mixed aspect of the fluidized bed. When exposed to a source of oxygen, the carbon in the char is readily oxidized by the reactant. If the char has poor ignition properties, oxygen can be introduced with the fluidizing gas to oxidize carbon in the solids in the fluidized bed to raise the temperature of the fluidized bed. During startup a fuel gas followed by air can be utilized as a fludizing gas to elevate the temperature of the solids in the fluidized bed above their ignition temperature.

Another advantage of the scheme described above is that the temperature in the riser is easily controlled by controlling the amount of oxygen fed to the fluidized bed in the fluidizing gas stream. Another advantage results from the large inventory of solids in the fluidized bed. Because of this large inventory minor system upsets are dampened by changes in the level of the fluidized bed. As the level in the fluidized bed increases additional solids are removed through the withdrawal line 1394 and additional solids are educted by the transport gas because of the higher differential pressure of the solids due to the increase in height of the bed. Conversely, as the level in the bed decreases fewer solids are withdrawn as product and less solids are educted by the transport gas because the differential pressure of the bed decreases. If any additional controls on the level of the fluidized bed are required the jet flow of the transport gas can be varied. Thus the fluidized bed is a self-compensating system.

Another advantage of the scheme is that because the solids are fluidized in the fluidized bed, withdrawal of solid product is facilitated. As the level of the solids in the fluidized bed rises, more solids are automatically withdrawn through the solids outlet line 1394.

A major advantage of the scheme shown in FIG. 4 is that it provides a comparatively "fail-safe" method of preventing oxygen in the combustion unit 1383 from entering the pyrolysis reactor. The height of the fluidized bed acts as a barrier against the backflow of oxygen into the pyrolysis reactor. In addition, automatic control means can be provided to sense the level of the fluidized bed, and if the level drops too low, the control means can automatically cut off the flow of the transport gas into the first combustion chamber.

A source of oxygen such as air heated in line 1357 is introduced through the gas inlet 1392 into the second oxidation stage 1352. The amount of free oxygen introduced into the second oxidation stage at least equals 50% of the molar amount of carbon monoxide entering the stage to completely oxidize carbon monoxide generated in the riser 1351 so that the total potential heating value of the char oxidized in the riser is obtained. In addition, oxygen above the stoichiometric amount can be added to react with the carbon in the char to heat the char to the temperature required to form the particulate source of heat for introduction into the pyrolysis zone. The total oxygen feed to the two oxidation stages is at all times sufficient to raise the solids to the temperature required for feed to the pyrolysis zone. Typically the particulate source of heat has a temperature from about 100° to 500° F. higher than the pyrolysis zone temperature.

The formed particulate source of heat and the gaseous combustion products of the solids, as well as nonreactive components of the transport gas such as nitrogen, pass from the oxidation zone to the cyclone separator 1361.

Although FIG. 4 shows the second oxidation stage and the cyclone separation zone 1361 as separate apparatuses, it is possible to form the particulate source of heat from the preheated solids and separate the particulate source of heat from the gaseous combustion products simultaneously in a single cyclone oxidation-separation zone. The advantages of using a cyclone oxidation zone for oxidizing char are discussed below in conjunction with the description of pyrolysis operation 2300.

Instead of oxidizing the char to form the particulate source of heat, the char can be heated by an electrical or gas furnace or by heat exchanger means.

The three cyclones 1361, 1362, and 1363 separate the char as well as any ash which may be formed by the complete oxidation of char from the combustion gases. These gases include the fluidizing gas, the inert components of the oxygen containing gas such as nitrogen, and the oxidation products of the char such as carbon monoxide, sulfur dioxide, and carbon dioxide. Most of the char is separated in the first char cyclone 1361 and dropped into the vertical inlet duct 1310 terminating in the reactor mixing zone 1312. The gaseous components, char particle fines, and ash are carried overhead to the secondary char cyclone 1362. In this cyclone the larger char particles carried over from the first stage cyclone 1361 are separated from the gas stream. A portion of these larger particles are sent to the char inlet duct 1310 and the remainder are fed to a char cooler in the product recovery operation 1500 (FIG. 5). Also sent to the char cooler are char particles in excess of what is required as the particulate source of heat for the pyrolysis reaction.

The gaseous overhead stream from the second char cyclone along with entrained char fines are cooled with a quench water stream 1368 and sent to the third char cyclone 1363. Fines and ash withdrawn from the third char cyclone are recycled to the char riser or transferred to the char cooler. An overhead gaseous effluent 1399 from the third char cyclone 1363 can be subjected to treatment in a sulfur dioxide removal unit (not shown) so that the gases can be flared without polluting the environment.

The vapor mixture from the first stage reactor cyclone 1321 can be quenched as required with a cooling water stream 1370 down to the dew point of the tars in the vapor mixture to stop the pyrolysis reaction and prevent degradation of the volatilized hydrocarbons. The vapor mixture is then combined with fluidizing gas 1371 from the char heater vessel 1342. Any particles in this combined gas stream are removed in a high efficiency, second stage reactor cyclone 1372, and sent to the char cooler, leaving the vapor mixture, which is sent to the product recovery operation 1500 (FIG. 5). It is important that practically all the char be removed from the vapor residue so that the product is not contaminated with char particles.

To the right of and below the dotted line in FIG. 6, the pyrolysis operation 2300 is depicted in detail. In this operation the comminuted coal is converted to form char and volatilized hydrocarbons.

With reference to FIG. 6 the comminuted dried coal with its transport gas is conveyed via line 2142 into a mixing region 2304 of a pyrolysis reactor 2302. Simultaneously with the introduction of the coal into the reactor, there is introduced a particulate heat source along with its transport gas stream 2305 via fluidized duct 2306. This particulate heat source is a material capable of transferring heat to the coal to cause its pyrolysis into volatilized hydrocarbons and char. As in the first version of the pyrolysis operation, the preferred heat source is char obtained from the devolatilization of coal in the pyrolysis reactor.

The conditions maintained in the pyrolysis reaction zone of this version of the invention are the same as those maintained in the reaction zone of the version shown in FIG. 4 and described above. The same reactor configurations as shown in FIGS. 7–10, described above, can be used with this version.

The solids in the pyrolysis reactor product stream 2308 are separated from the vapor in a cyclone separation stage comprising three cyclones 2311, 2312, 2313, in series. The primary cyclone separator 2311 is a medium efficiency separator which removes most of the char particulates from the gas stream. Most of the finer particles are separated in the high efficiency secondary 2312 and tertiary 2313 reactor cyclones, and collected in bins 2316 and 2317, respectively. The char in bins 2316 and 2317 is sold as char product for boiler feed. By removing the fine char particles separated in the second 2312 and tertiary 2313 cyclone stages from the circulating char system used to heat the pyrolysis reactor 2302, the amount of circulating fines in the char system is decreased. This is important in keeping the char fines from going overhead from the tertiary reactor cyclone 2313 and contaminating the tar product.

Preferably the char collected in lines 2316 and 2317, along with particulate source of heat fines collected in line 2382 as described below, represent the net production of solids of the process. Thus as coal is pyrolyzed to produce char, fines are selectively withdrawn from the char inventory while larger char particles are left in the char combustion loop to form the particulate source of heat. This helps prevent contamination of the hydrocarbon product with fines carried over from the tertiary reactor cyclone 2313. If more char passes overhead from the primary reactor cyclone 2311 than is produced during pyrolysis of the coal, a portion of the char separated by the secondary cyclone can be diverted via line 2381 into the char surge bin 2324.

The vapor mixture 2322 from the tertiary cyclone is sent to a product recovery operation. The char separated by the primary reactor cyclone 2311 drops into a char surge bin 2324 to be pneumatically carried through the char combustion loop.

The bed of char in the surge bin 2324 is static. The pressure required for feeding the circulating char from the surge vessel 2324 to the reactor 2302 is provided by the static pressure of char in the surge bin and compaction provided by a screw feeder 2326. It is important that the screw feeder 2326 deliver a steady flow rate of char with a constant bulk density into the conveying gas stream to prevent upsets of the pyrolysis reaction zone.

At least a portion of the heat required for the pyrolysis operation is obtained by subjecting at least a portion of the separated char to at least partial oxidation in the presence of a course of oxygen such as air in a combustion or oxidation zone comprising two oxidation stages in series. The screw feeder 2326 compacts and conveys the char at a controlled feed rate into a transport line or riser 2348 which serves as a first oxidation stage. The char is carried in transport line 2348 as a dense solids phase in a transport gas to a cyclone oxidation-separation zone 2351, which serves as a second oxidation stage.

The transport gas preferably contains free oxygen, and combustion during transport generates carbon monoxide. Other reactants which lead to the formation of carbon monoxide may also be present. These include steam and carbon dioxide. When steam is present, hydrogen also is formed.

In the preferred process, the transport gas contains, as indicated, some oxygen to generate a portion of the heat necessary to raise the char to the temperature required for feed to the pyrolysis reactor. However, the amount of oxygen is limited to prevent production of too much carbon monoxide into the second oxidation stage.

With reference to FIG. 6, the transport gas can be a hot air stream mixed with a diluent gas essentially free of free oxygen such as nitrogen or a transport gas obtained from the noncondensible fraction of the volatilized hydrocarbons resulting from the pyrolysis of the coal or simply flue gas. The diluent gas is added to the hot air to provide sufficient gas velocity to convey the char to the oxidation zone. The hot air stream is obtained from a compressor 2352 which blows air through an air heater 2354 and into the transport line 2348 via line 2355. For startup purposes, hot gas obtained by burning natural gas in the presence of air in a gas generator 2358 is added through line 2356 to the char to provide sufficient heat for pyrolysis.

The oxygen in the air reacts exothermically with carbon in the char to produce gaseous combustion products including carbon monoxide. Thus the transfer line 2348 serves as a first oxidation stage for oxidizing the char to form the particulate source of heat while the cyclone oxidation-separation zone 2351 serves as a second oxidation stage. The gaseous combustion products and the transport gas transport the solids to the cyclone oxidation-separation stage 2351. The amount of free oxygen fed to the second oxidation stage or cyclone oxidation-separation stage 2351 at least equals 50% of the molar amount of carbon monoxide entering the stage. The total oxygen feed is at all times sufficient to raise the solids to the temperature required for feed to the pyrolysis zone. The remaining heat required preferably is obtained by taking some of the air compressed by a compressor 2352, heating the compressed air in a heater 2360 and feeding the heated air via line 2362 to the cyclone oxidation-separation zone 2351, where it is combined with the partially oxidized char. In the oxidation zone 2351 a portion of the carbon present is oxidized to a higher oxidation state. The heated air can be introduced into the line 2348 carrying the char to the cyclone 2351 through a tube coaxial with line 2348.

Because the amount of oxygen introduced into the oxidation zone is at least the stoichiometric amount required to completely oxidize carbon monoxide generated in the transport line 2348, the total potential heating value of the char oxidized in the transport line is normally obtained. As required, oxygen above the stoichiometric amount can be added to react with the carbon in the char to heat the char to the temperature required to form the particulate source of heat for introduction into the pyrolysis zone.

The cyclone oxidation-separation zone 2351 is maintained at a temperature consonant with the temperature requirements of the pyrolysis reaction zone. Depending upon the weight ratio of the particulate source of heat to coal in the pyrolysis reaction zone, the combustion zone is maintained at a temperature from about 100° to about 500° F. or more higher than the pyrolysis reaction zone.

Introducing oxygen to the char in two oxidation stages where the balance of the oxygen is introduced at the inlet of a cyclone serves to obtain maximum heating value from the char by oxidation. When char is oxidized where there is less than stoichiometric amounts of oxygen and/or the residence time is long, then some of the carbon dioxide in the reaction product gases tends to react with the char to produce carbon monoxide. This is undesirable because more valuable char has to be burned to achieve desired char temperatures than if carbon dioxide were the only product. Net carbon monoxide formed is minimized and the carbon dioxide to carbon monoxide ratio maximized to maximize the amount of heat generated per unit amount of free carbon combusted by using two oxidation stages.

In the processes shown in FIGS. 4 and 6, the char preferably is burned at least partially in cyclone oxidation-separation zones 1361 and 2351, respectively, where it is separated from the gases in a very short time, thus selectively maximizing carbon dioxide production. Another advantage of using a cyclone vessel for reacting the char with an oxygen containing gas is that separation of the combustion gases from the char and combustion of the char are accomplished in the same vessel, the cyclone. This reduces capital and operating costs. Also, consumption of char is reduced at a given temperature. In addition, the char particle fines, which are less valuable than the larger char particles, are burned preferentially because of the fast separation of the large particles in the cyclone.

When oxidizing char in a cyclone combustion-separation zone, preferably the residence time in the cyclone is less than about 5 seconds, and more preferably from about 0.1 to about 3 seconds to minimize carbon monoxide formation which occurs at longer residence times. There is more opportunity for carbon dioxide formed to react with char to form carbon monoxide according to the reaction $C+CO_2 \rightarrow 2CO$. The term "residence time" as applied to a cyclone separation-oxidation zone means the average residence time of the gas phase of the feed to the cyclone.

Referring to FIG. 6, the particulate source of heat is separated from the transport gas, nonreactive components of the oxygen source, and combustion gas in a second cyclone separation stage comprising the cyclone oxidation-separation zone 2351 and a char cyclone 2380. The bulk of the solids are separated in the cyclone oxidation-separation zone simultaneously with the oxidation of the char. The gaseous overhead stream 2378 from the cyclone oxidation-separation zone 2351 flows into the char cyclone 2380 where char fines and any ash resulting from the complete oxidation of char are separated and dropped into a container 2382 for sale as boiler feed. Unlike in the version of this invention shown in FIG. 4, these char particles are not sent to the reaction zone. Thus the inventory of fines in the char loop is minimized and there is less chance of char particles going overhead from the tertiary reactor cyclone 2313 and contaminating the hydrocarbon product. The gas 2384 discharged from the secondary char cyclone 2382 is vented to a gas cleanup operation for purification before it is vented to the atmosphere.

The char recovered in the cyclone oxidation-separation zone 2351, which preferably is substantially free of fines less than about 10 microns in diameter, is introduced to the mixing section 2304 of the pyrolysis reaction zone 2302 through a fluidized duct 2306. A fluidized duct is used to ensure a steady flow of char into the annular mixing zone 2304. The fluidizing gas preferably is nondeleteriously reactive with respect to pyrolysis products.

The fluidized char duct or standpipe 2306 in combination with the char cyclone oxidation-separation zone 2351 is a self compensating system which tends to maintain a constant flow rate of char at a constant pressure to the reactor. For example, if fewer char particles are entering the mixing zone of the reactor, the level of char in the char duct 2306 increases, which tends to increase the static pressure of the char and thereby force more char into the reactor.

Surplus char produced by the pyrolysis reaction beyond what is removed by the secondary 2312 and tertiary 2313 reactor cyclones and the char cyclone 2380 is withdrawn from the char surge bin 2324 and sent to a product char bin in the product recovery operation.

In the process shown in FIG. 6 particulate contamination of the liquid hydrocarbons resulting from the pyrolysis of the coal is minimized because of four novel features. First, in the coal preparation operation the production of fines is minimized in the comminution step by initially comminuting the coal so that a portion of the coal is larger than the maximum particle size fed to the pyrolysis reactor. Second, fines produced during the comminution are separated from the coal. Third, in the pyrolysis operation, fines are removed from the char before subjecting the char to oxidation to prepare the particulate source of heat. And fourth, also in the pyrolysis operation, fines in the particulate source of heat are removed before feeding the particulate source of heat to the pyrolysis reaction zone. These four features may be used separately or jointly to reduce solid contamination of the liquid hydrocarbons.

E. Product Recovery Operation

Product recovery operation 1500 is shown in detail to the left of the dotted line in FIG. 5. In the product recovery operation 1500, values are obtained from the pyrolytic vapor mixture.

Char produced during the pyrolysis operation and not utilized as a particulate source of heat is cooled prior to sale such as by collecting the char in the char cooler 1502 in which a circulating stream of water cools the char by indirect heat exchange. If the bed temperature in the cooler is maintained at a temperature higher than 212° F. or a countercurrent flow configuration is used, steam can be generated from the cooling water. Gas in the char cooler can be vented to a sulfur dioxide removal unit (not shown) so that the gas can be flared without polluting the atmosphere. After the char is cooled to about 650° F., the char is withdrawn from the char cooler as char product, one of the valuable products obtained by the process of this invention.

The product char can have some of its heat reclaimed by conventional heat exchanger devices (not shown). The product char has many uses. For example, the product char can be used as a power plant fuel, it can be used as a raw material for synthetic coke, for metallurgical applications or for activated carbon, and it can be used as a raw material for synthetic fuel gas production.

The product char particles can readily be degasified by stripping them with a hot stripping gas or by heating the particles to temperatures ranging from about 1200° F. to 1800° F. to yield a hydrogen rich gas stream which is saleable as premium fuel, which can be upgraded to pure hydrogen, or which can be used for hydrotreating the heavier volatilized hydrocarbons evolved during pyrolysis.

The pyrolytic vapor mixture comprises volatilized hydrocarbons, carrier gases used to convey carbonaceous material to the pyrolysis reaction zone, and nonhydrocarbon components such as hydrogen sulfide which may be generated in the pyrolysis reaction. The volatilized hydrocarbons have a wide range of boiling points ranging from methane with a boiling point of −259° F. to heavy, viscous tars which carbonize before distillation.

In general, hydrocarbon values are recovered from the vapor mixture by progressively cooling the vapor mixture in a plurality of gas-liquid cooling-condensation stages in series, the liquid coolant of each stage including the condensate of that stage. The temperature of the coolant for each stage is below the temperature of the vapor feed to the stage and the vapor effluent from the stage. The condensate of each stage is progressively lower in average boiling point and tar content. The vapor effluent, which contains residual uncondensed hydrocarbons, from the last of the cooling stages is passed to a quench cooling stage where it is admixed with water to form an immiscible mixture of water condensate and a low boiling hydrocarbon oil condensate. The water is then separated from the low boiling oil condensate. Alternately cooled low boiling hydrocarbon oil condensate can be used in the quench cooling stage to contact the vapor effluent from the last of the cooling stages.

In the process of this invention, four liquid hydrocarbon fractions are recovered from the pyrolytic vapor. These are the low boiling hydrocarbon fraction containing $C_4$'s to constituents having a boiling point up to about 350° F., the intermediate boiling hydrocarbon fraction containing constituents having a boiling point in the range of from about 250° to about 650° F., and two tar fractions containing in combination constituents having a boiling point greater than about 550° F.

The pyrolytic vapor mixture streams 1374, 2322 are cooled in a cooling zone 1506 which comprises at least two gas-liquid cooling-condensation stages in series. In each cooling stage a gaseous fraction of increasingly higher boiling point of the vapor mixture is partially condensed by a circulating cooling steam consisting of a portion of condensed feed to that stage. Indirect and direct cooling apparatuses can be utilized as a cooling stage, including venturi scrubbers, shell-and-tube heat exchangers, and the like.

Referring to FIG. 5, the cooling zone 1506 comprises three wash towers as cooling stages, a first, second and a third stage wash towers 1511, 1512 and 1513, respectively. Upstream of the first stage wash tower 1511 the pyrolytic vapor mixture can be combined with a quench water stream 1516. This stream is then passed to the first stage wash tower 1511 where it is contacted by a circulating tar-rich stream 1517. A liquid tar-rich stream 1518 is pumped by pump 1520 from the bottom of the first stage wash tower 1511. A portion of the bottom stream 1518 is cooled in an indirect heat exchange zone 1522 and the recycled as the circulating tar-rich stream 1517 to the first stage wash tower 1511. For about every pound of gaseous resultant pyrolysis product fed to the first stage wash tower, about four pounds of circulating tar-rich liquid 1517 are recycled to the wash tower 1511. The portion of the liquid bottoms from the first stage wash tower not recycled to the wash tower is cooled in a water cooled heat exchange zone 1524 and then withdrawn as heavy tar product.

The first stage wash tower is operated at a temperature of from about 600° to about 700° F. At temperatures higher than 700° F. cracking and degradation of the hydrocarbon product can occur. At temperatures less than 600° F., too much lighter hydrocarbon ends up in the tar product stream.

After demisting, a gaseous tar-lean stream 1528 is withdrawn from the top of the first stage wash tower 1511. This stream is fed to the subsequent cooling stage, the second stage wash tower 1512, for further cooling and withdrawal of product tar as was done in the first stage wash tower. The gaseous tar-lean stream 1528 is cooled to a temperature of about 550° F. by a circulating stream 1520 which contains a portion of a liquid tar-rich stream 1531 which was withdrawn from the bottom of wash tower 1512 and pumped by pump 1532 through a heat exchanger 1534. From about 4 to about 5 pounds of cooled circulating tar-rich liquid 1530 are fed to the second stage wash tower 1512 for each pound of gaseous tar-lean stream 1528 from the first stage wash tower 1511. The liquid fraction withdrawn from the bottom of the second stage wash tower not recycled to the wash tower is cooled in a heat exchanger zone 1540 and then sent to storage as medium boiling tar product. Thus in the recovery operation 1500 shown in FIG. 5, the tar fraction of the pyrolytic product is collected as heavy and medium tar product streams.

After demisting, a gaseous tar-lean stream 1542 having a temperature of about 600° F. is withdrawn from the second stage cooling tower 1512 and sent to the third stage cooling tower 1513, the last cooling stage of cooling zone 1506. The temperature of the gaseous stream 1542 is reduced to about 220° F. in cooling stage 1513 using the same method as used in the prior two cooling stages, i.e., a circulating liquid coolant stream 1546 containing condensate is withdrawn from the bottom of the wash tower, pumped by a pump 1548 through an indirect heat exchanger 1550 in which it is cooled to about 170° F., and recycled to the wash tower where it contacts the incoming vapor effluent 1542 from the prior cooling-condensation stage. From about 4 to about 8 pounds of cooled circulating liquid are used for each pound of gaseous feed to the third stage cooling tower 1513. The portion of the liquid withdrawn from the bottom of the third stage wash tower not recycled to the wash tower is cooled in a heat exchange zone 1552 and withdrawn as intermediate boiling product.

After demisting, a gaseous tar-lean effluent stream 1554 containing water, condensible low boiling hydrocarbons, and noncondensible hydrocarbons is withdrawn from the top of the third stage wash tower 1513 and admixed with a circulating cooling water stream 1556 in quench cooling stage such as a venturi scrubber 1558, thereby forming an immiscible mixture of water and a light hydrocarbon oil condensate having a temperature of about 90° F. The immiscible mixture is then passed to a separator drum 1560. In the separator drum 1560, three phases are present: a bottom aqueous phase 1561, a middle low boiling hydrocarbon phase 1562, and a top gaseous phase 1563. The aqueous phase 1561 is pumped by pump 1564 through a water cooler 1566 where it is cooled to about 80° F., and a portion is recycled to the venturi scrubber 1558. The rest of the water is treated to remove pollutants and recover dissolved hydrocarbons and then sent to disposal. The oil phase 1562 is withdrawn and conveyed by a pump 1568 to storage as a low boiling product stream or recycled to the third stage cooling tower. The stream can be decanted to remove any residual water from it and further processed to upgrade the commercial value of the product as by hydrotreating.

The gaseous phase in the separator drum is withdrawn as stream 1570 and conveyed to gas clean-up operation 1700.

A venturi contactor can be placed upstream of any or all of the wash towers to achieve intimate contact between the vapor feed and cooling stream introduced to each wash tower.

Figure 11:
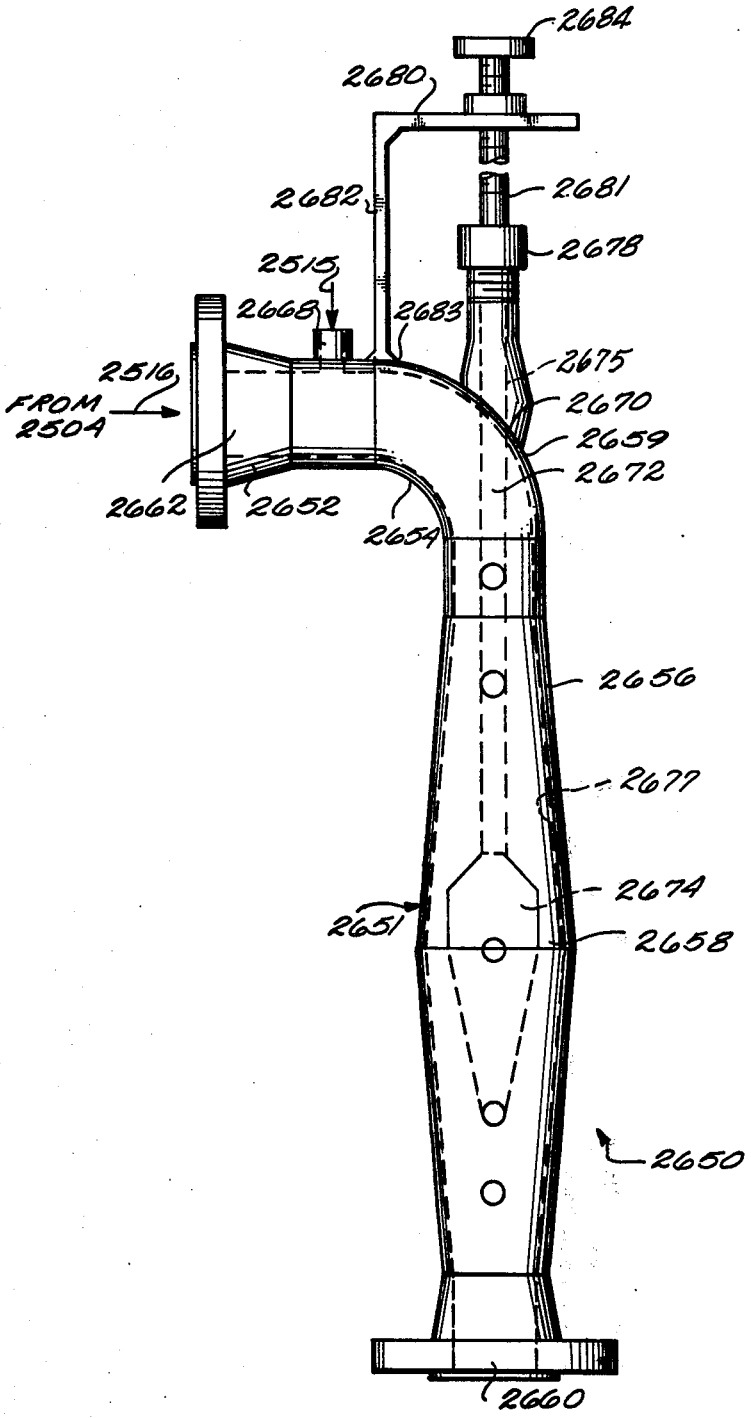
FIG. 11 shows a variable throat venturi scrubber useful for removing tar aerosols from a gas stream.

When a venturi is used in the product recovery operation, it is desirable that the venturi be highly efficient. FIG. 11 shows a variable throat venturi 2650 which is particularly effective for cooling pyrolytic vapors and preventing tar aerosol carry over. The body 2651 of the venturi 2650 comprises a short inlet section 2652, a 90 elbow 2654 and an elongated throat 2656 which tapers outwardly from the elbow 2654 to form a large midsection 2658 and then tapers inwardly to form the outlet 2660 from the venturi. The vapor stream 2516 from the quench tower 2504 enters the opening 2662 at the inlet section 2652. The cooled light fraction stream 2515 enters the inlet section of the scrubber through a port 2668 which is transverse, and preferably perpendicular to the wall of the inlet section 2652. On the wall 2659 at the outer radius of the elbow section 2650 is an opening 2670. Projecting through this opening 2670 is an elongated cylindrical bar 2672 having a torpedo shaped bulb 2674 suspended from one end. The side wall 2690 of the bulb at the top of the bulb is tapered to match the taper of the inner wall 2677 of the throat 2656 tapering outwardly towards the midsection. Preferably the bulb is symmetrical about the longitudinal axis of the throat section 2650 so that a flow space of uniform cross-sectional area is maintained between the bulb and the inner wall of the throat section. The upper portion 2681 of the cylindrical bar 2672 is threaded and extends through a pipe 2675 welded to the wall around the opening. The pipe is filled with packing to prevent leakage out of the venturi. At the top of the pipe, which is threaded, a nut 2678 is attached to hold the packing in place.

The size of the opening in the throat of the venturi is controlled by positioning the torpedo shaped bulb 2674. When the bulb is located at the largest portion 2658 of the throat as shown in FIG. 11, the cross-sectional area for the combined liquid/gas stream in the venturi scrubber is at its maximum and thus the velocity of the stream is at its lowest. As the bulb 2674 is raised or lowered to a narrower section in the throat, the velocity in the scrubber increases. If the bulb is raised so that the side wall 2690 of the bulb seats against the inner wall 2677 of the throat, flow is completely cut off. Therefore the velocity through the scrubber can be controlled to ensure intimate contact between the liquid and gas while at the same time minimizing the energy required for pumping the gas and liquid through the venturi.

The position of the torpedo shaped bulb 2674 is controlled by a rigidly fixed structure comprising a laterally extending bar 2680 and a nut 2691 mounted on the top of the bar. The top portion 2681 of the vertical pipe 2672 located above the elbow portion of the valve extends through both the nut and the laterally extending arm. The adjustment means also includes an arm 2682 extending from the end of the bar 2680 to the surface 2683 of the inlet section 2652 of the scrubber. The vertical pipe is turned by a handle 2684 secured to the end of the pipe and thereby raised or lowered through the bar 2680 by means of the adjustment nut 2691. The positioning of the bulb 2674 can be effected by a motor controlled by automatic control means.

Although the variable throat venturi has been described as being utilized as a scrubber for contacting the vapor stream from the quench tower 2504 with the cooled light fraction 2515, this high efficiency venturi can be used throughout the product recovery operation wherever liquid/gas contacting occurs.

F. Gas Cleanup Operation

The gas cleanup operation 1700 is shown in detail to the right of the dotted line in FIG. 5. The purpose of the gas cleanup operation 1700 is to remove noxious substances from the gas stream 1570 which, if discharged to the atmosphere, would pollute the environment. A portion of the gas stream 1570 is compressed in a compessor stage 1702 and sent to the coal preparation and pyrolysis operations where it is utilized as aeration gas and transport gas. The remainder of the gas stream is conveyed to an acid gas removal unit 1704 where the hydrogen sulfide in the gas is removed. After removal of hydrogen sulfide the gas stream can be flared and sent to the atmosphere, can be used as a fuel gas, or can be used as a feed gas for additional process steps such as conversion to pipe line quality natural gas or ammonia production.

The hydrogen sulfide rich stream 1708 from the acid gas removal unit can be sent to a unit which converts the hydrogen sulfide to sulphur such as a Claus unit 1710. In the Claus unit about one third of the hydrogen sulfide is oxidized to sulphur dioxide and then reacted with the remaining hydrogen sulfide to form sulphur and water. Sulphur recovered in the Claus unit 1710 can be sold as product. The off gas stream 1712 from the Claus unit is flared and then sent to the atmosphere.

Although this invention has been described in terms of two main coal preparation and pyrolysis operations it should be understood that the different operations of each route are interchangeable. For example, coal preparation operation 1100 can be used in place of coal preparation operation 2100 and vice versa. The same is true with the pyrolysis operations.

Both routes result in high product yield. From each pound of coal feed about 33% is recovered as tar and light oil, about 1.5% as water, about 6.6% as gas, about 53% as char and the remainder is oxidized for heat for pyrolysis. This recovery of about 33% tar and light oils represent a yield of synthetic crude oils of almost two barrels per ton of coal after hydrogenation, which is significantly greater than other pyrolysis processes.

These and other advantages of the coal conversion process of this invention are shown by the following example.

EXAMPLE

About 25,000 pounds per hour of an agglomerative bituminous coal containing about 10% water by weight is fed to the coal preparation operation where it is contacted with a hot gas stream to reduce the moisture content of the coal and then is crushed to a particle size less than 200 mesh. The crushed partially dried coal is carried by a carrier gas which is nondeleteriously reactive with respect to pyrolysis products to a pyrolysis reactor zone of the design shown in FIG. 9 where it is combined under turbulent flow conditions with hot circulating char which heats the coal to a temperature of 1075° F. to yield by pyrolysis of the coal volatilized hydrocarbons and char. Over 99% of the char is separated from the pyrolysis product stream and a portion of the char is subjected to partial oxidation in the presence of air to heat the char for recycle to the pyrolysis reaction zone. The remainder of the char, amounting to 10,000 pounds per hour, is separated as char product.

The condensible hydrocarbons in the pyrolysis product stream are then condensed by contacting them with a circulating liquid stream in a plurality of liquid gas contacting stages. Tar and light oil are recovered at the rate of 7,000 pounds per hour and product gas is recovered at the rate of 1500 pounds per hour.

Although this invention has been described in considerable detail with reference to certain embodiments thereof, it will be understood that variations and modifications can be effected within the spirit and scope of the invention as described above and defined in the appended claims.

What is claimed is:

1. A continuous process for recovery of values contained in solid carbonaceous materials which comprises the steps of:

(a) providing a feed stream containing a particulate solid carbonaceous material, a substantial portion of the particulate solid carbonaceous material being of a particle size less than about 1000 microns in diameter;

(b) subjecting the solid carbonaceous material particles to flash pyrolysis by continuously:

(i) transporting the solid carbonaceous material containing feed stream contained in a carrier gas which is substantially nondeleteriously reactive with respect to products of pyrolysis of the solid carbonaceous material to a solids feed inlet of a substantially vertically oriented, descending flow pyrolysis reactor having a substantially vertically oriented pyrolysis zone operated at a pyrolysis temperature above about 600° F.;

(ii) feeding a particulate source of heat at a required temperature above the pyrolysis temperature to a substantially vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to products of pyrolysis of the solid carbonaceous material;

(iii) discharging the particulate source of heat over said weir and downwardly into said mixing region at a rate sufficient to maintain said pyrolysis zone at the pyrolysis temperature;

(iv) injecting the solid carbonaceous material feed stream and carrier gas from the solids feed inlet into the mixing region to form a resultant turbulent mixture of the particulate source of heat, the solid carbonaceous material particles and carrier gas;

(v) passing the resultant turbulent mixture downwardly from said mixing zone to the pyrolysis zone of said pyrolysis reactor to pyrolyze the solid carbonaceous material particles and yield a pyrolysis product stream containing as particulate solids, the particulate source of heat and a carbon containing solid residue of pyrolysis of the solid carbonaceous material particles, and a vapor mixture of carrier gas and pyrolytic vapors comprising volatilized hydrocarbons and tars;

(c) passing the pyrolysis product stream from said pyrolysis reactor to a separation zone to separate at least the bulk of the particulate solids from the vapor mixture;

(d) forming the particulate source of heat by:

(i) transporting the separated solids from the separation zone to a cyclone oxidation-separation zone with a transport gas containing free oxygen with resultant carbon monoxide formation from the carbon in the solids; and (ii) combining the transported particulate solids, carbon monoxide and transport gas in the cyclone oxidation-separation zone with a source of free oxygen in an amount at least equal to 50 mole percent of the carbon monoxide entering the cyclone oxidation-separation zone, the total free oxygen in the transport gas and combined in the cyclone oxidation-separation zone being sufficient to raise the solids to the temperature required for feed to the substantially vertically oriented chamber, while simultaneously separating the bulk of the particulate source of heat from the gases present in the cyclone oxidation-separation zone to form the feed to the substantially vertically oriented chamber; and (e) recovering hydrocarbon values from the vapor by progressively cooling the vapor mixture in a plurality of gas-liquid cooling-condensation stages in series, each stage having a liquid coolant, a vapor feed, a vapor effluent, and liquid condensate, the liquid coolant of each stage including condensate of the stage, the liquid coolant of each stage being below the temperature of the vapor feed to the stage and vapor effluent of the stage, the condensate of each stage being progressively lower in average boiling point and tar content.

2. A process as claimed in claim 1 in which the pyrolysis temperature is from about 600° to about 2000° F.

3. A process as claimed in claim 1 in which the pyrolysis temperature is from about 600° to about 1400° F.

4. A process as claimed in claim 1 in which the pyrolysis temperature is from about 900° to about 1400° F.

5. A process as claimed in claim 1 in which a substantial portion of the particles of the solid carbonaceous material are particles in the range from about 10 to about 1000 microns in diameter.

6. A process as claimed in claim 1 in which the solid carbonaceous material is an agglomerative coal, and a substantial portion of the particulate solid carbonaceous material is of a particle size less than about 250 microns in diameter.

7. A process as claimed in claim 1 in which the particulate solid carbonaceous material is an agglomerative coal, and a substantial portion of the particulate solid carbonaceous material is of a particle size in the range of from about 10 to about 250 microns in diameter.

8. A process as claimed in claim 1 in which the resultant turbulent mixture has a solids content ranging from about 0.1 to about 10% by volume based on the total volume of the resultant turbulent mixture and a weight ratio of the particulate source of heat to solid carbonaceous material feed of from about 2 to about 20:1.

9. A process as claimed in claim 1 having a pyrolysis time of less than about 5 seconds.

10. A continuous process for recovery of values contained in solid carbonaceous materials comprising the steps of:

(a) providing a particulate solid carbonaceous material feed stream substantially containing particles of a size from about 10 to about 1000 microns in diameter;

(b) subjecting the solid carbonaceous material particles to flash pyrolysis by continuously:

(i) transporting the solid carbonaceous material feed stream contained in a carrier gas substantially nondeleteriously reactive with respect to the products of pyrolysis of the solid carbonaceous material to a solids feed inlet of a vertically oriented, descending flow pyrolysis reactor having a pyrolysis zone operated at a pyrolysis temperature of from about 600° to about 2000° F.;

(ii) feeding a particulate source of heat at a required temperature above the pyrolysis temperature to a vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to the products of pyrolysis of the solid carbonaceous material;

(iii) discharging the particulate source of heat over said weir and downwardly into said mixing region at a rate sufficient to maintain said pyrolysis zone at the pyrolysis temperature;

(iv) injecting the solid carbonaceous material feed stream and carrier gas from the solids feed inlet into the mixing region to form a resultant turbulent mixture of said particulate source of heat, solid carbonaceous material particles and carrier gas;

(v) passing the resultant turbulent mixture downwardly from said mixing zone to the pyrolysis zone of said pyrolysis reactor to pyrolyze the solid carbonaceous material particles and yield a pyrolysis product stream containing as solids, the particulate source of heat and a carbon containing solid product of pyrolysis of the solid carbonaceous material particles, and a vapor mixture of carrier gas and pyrolytic vapors comprising volatilized hydrocarbons and tars, the pyrolysis time being less than about 5 seconds;

(c) passing the pyrolysis product stream from said pyrolysis reactor to a first cyclone separation stage to separate the bulk of the solids from the vapor mixture;

(d) forming the particulate source of heat by:

(i) passing at least a portion of the solids from the first cyclone separation zone to a fluidized bed around a substantially vertically oriented, open riser;

(ii) educting solids from the fluidized bed into the riser by injecting a transport gas containing free oxygen upwardly into the riser to transport the solids through the vertically oriented riser to a cyclone oxidation-separation stage with resultant carbon monoxide formation from the carbon in the solids; and (iii) combining the particulate solids, carbon monoxide and transport gas in the cyclone oxidation-separation stage with a source of oxygen in an amount at least equal to 50 mole percent of the carbon monoxide entering the cyclone oxidation-separation stage, the total free oxygen in the transport gas and combined in the cyclone oxidation-separation stage being sufficient to raise the solids to the temperature required for introduction to the vertically oriented chamber by oxidizing a portion of the total carbon present to a higher oxidation stage, while simultaneously separating the bulk of the particulate source of heat from the gases present in the cyclone oxidation-separation stage to form the feed to the vertically oriented chamber; and (e) recovering hydrocarbon values from the vapor mixture by:

(i) progressively cooling the vapor mixture in a plurality of gas-liquid cooling-condensation stages in series, each stage having a liquid coolant, a vapor feed, a vapor effluent, and liquid condensate, the liquid coolant of each stage including the condensate of the stage, the liquid coolant of each stage being below the temperature of the vapor feed to the stage and the vapor effluent of the stage, the condensate of each stage being progressively lower in average boiling point and tar content;

(ii) passing the vapor effluent containing residual hydrocarbons from the last of said cooling stages to a quench cooling stage and admixing the effluent with water to form an immiscible mixture of water and a low boiling hydrocarbon oil condensate from the residual hydrocarbons and separating the water from the low boiling hydrocarbon condensate.

11. The process of claim 10 in which the fluidized bed is fluidized by a fluidizing gas containing oxygen.

12. A process as claimed in claim 10 in which the solid carbonaceous material is an agglomerative coal and the solid carbonaceous material feed stream substantially contains particles of a size from about 10 to about 250 microns.

13. A process as claimed in claim 10 in which the resultant turbulent mixture has a solids content ranging from about 0.1 to about 10% by volume based on the total volume of the resultant turbulent mixture and a weight ratio of the particulate source of heat to solid carbonaceous material feed of from about 2 to about 20:1.

14. A process as claimed in claim 10 in which the pyrolysis temperature is from about 900° to about 1400° F.

15. A process as claimed in claim 10 in which the pyrolysis temperature is from about 600° to about 1400° F.

16. A process as claimed in claim 10 in which the pyrolysis time is from about 0.1 to about 3 seconds.

17. A process as claimed in claim 10 in which the residence time in the cyclone oxidation-separation stage is less than about 5 seconds.

18. A process as claimed in claim 10 in which the residence time in the cyclone oxidation-separation stage is from about 0.1 to about 3 seconds.

19. A continuous process for recovery of values contained in agglomerative coals which comprises the steps of:

(a) providing a particulate agglomerative coal feed stream containing agglomerative coal particles of a size less than about 250 microns in diameter;

(b) subjecting the particulate coal feed stream to flash pyrolysis by continuously:

(i) transporting the particulate coal feed stream and a carrier gas which is substantially nondeleteriously reactive with respect to the products of pyrolysis of the coal feed to a solids feed inlet of a vertically oriented, descending flow pyrolysis reactor having a pyrolysis zone operated at a pyrolysis temperature from about 600° to about 2000° F.

(ii) feeding a particulate source of heat at a required temperature above the pyrolysis temperature, and comprising heated carbon containing solid residue of pyrolysis of coal, to a vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to the products of pyrolysis of the coal feed;

(iii) discharging the particulate source of heat over said weir and downwardly into said mixing region at a rate sufficient to maintain said pyrolysis zone at the pyrolysis temperature;

(iv) injecting the particulate coal stream and carrier gas from the solids feed inlet into the mixing region to form a resultant turbulent mixture of said particulate source of heat, particulate coal feed stream and carrier gas;

(v) passing the resultant turbulent mixture downwardly from said mixing zone to the pyrolysis zone of said pyrolysis reactor to pyrolyze the coal feed stream and yield a pyrolysis product stream containing as solids, the particulate source of heat and a carbon containing solid residue of pyrolysis of the coal feed, and a vapor mixture of carrier gas and pyrolytic vapors comprising volatilized hydrocarbons and tars, the pyrolysis time being less than about 5 seconds;

(c) passing the pyrolysis product stream from said pyrolysis reactor to a cyclone separation zone to separate the solids from the vapor mixture;

(d) forming the particulate source of heat by:

(i) passing at least a portion of the separated solids to a fluidized bed around a substantially vertically oriented open riser;

(ii) educting solids from the fluidized bed into the riser by injecting a transport gas containing free oxygen upwardly into the riser to transport solids through the vertically oriented riser to a cyclone oxidation-separation zone with resultant carbon monoxide formation from carbon in the solids; and (iii) combining the particulate solids, carbon monoxide and transport gas in the cyclone oxidation-separation zone with a source of free oxygen in an amount at least equal to 50 mole percent of the carbon monoxide entering the cyclone oxidation-separation zone, the total free oxygen in the transport gas and combined in the oxidation-separation zone being sufficient to raise the solids to the temperature required for introduction to the vertically oriented chamber while simultaneously separating the particulate source of heat from gaseous combustion products of the solids for feed to the vertically oriented chamber surrounding the upper portion of the pyrolysis reactor; and (e) recovering hydrocarbon values from the vapor mixture by:

(i) progressively cooling the vapor mixture in a plurality of gas-liquid cooling-condensation stages in series, the liquid coolant of each stage including the condensate of the stage, each stage having a liquid coolant, a vapor feed, a vapor effluent and liquid condensate, the coolant of each stage condensate, the coolant of each stage being below the temperature of the vapor feed to the stage and vapor effluent of the stage, the condensate of each stage being progressively lower in boiling point and tar content;

(ii) passing the vapor effluent containing residual hydrocarbons from the last of said cooling stages to a quench cooling stage and admixing the effluent with water to form an immiscible mixture of water and a low boiling hydrocarbon oil condensate from the residual hydrocarbons and separating the water from the low boiling hydrocarbon condensate.

20. The process of claim 19 in which the particulate source of heat is passed from the cyclone oxidation-separation zone to the vertically oriented chamber surrounding the upper portion of the pyrolysis reactor through a vertically oriented standpipe fluidized with a gas which is nondeleteriously reactive with respect to pyrolysis products of the coal feed.

21. A process as claimed in claim 19 in which the resultant turbulent mixture has a solids content ranging from about 0.1 to about 10% by volume based on the total volume of the resultant turbulent mixture, and a weight ratio of the particulate source of heat to the coal feed of from about 2 to about 20:1.

22. A process as claimed in claim 19 in which the pyrolysis temperature is from about 900° to about 1400° F.

23. A process as claimed in claim 19 in which a substantial portion of the agglomerative coal particles are particles in the range from about 10 to 250 microns.

24. A process as claimed in claim 19 in which the residence time in the cyclone oxidation-separation zone is less than about 5 seconds.

25. A process as claimed in claim 19 in which the residence time in the cyclone oxidation-separation zone is from about 0.1 to about 3 seconds.

26. A continuous process for recovery of values contained in solid carbonaceous materials which comprises the steps of:

(a) providing a feed stream containing a particulate solid carbonaceous material, a substantial portion of the particulate solid carbonaceous material being of a particle size less than about 1000 microns in diameter;

(b) subjecting the solid carbonaceous material particles to flash pyrolysis by continuously:

(i) transporting the solid carbonaceous material feed stream contained in a carrier gas which is substantially nondeleteriously reactive with respect to the products of pyrolysis of the solid carbonaceous material to a solids feed inlet of a substantially vertically oriented, descending flow pyrolysis reactor having a substantially vertically oriented pyrolysis zone operated at a pyrolysis temperature above about 600° F.;

(ii) feeding a particulate source of heat at a temperature above the pyrolysis temperature to a substantially vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to the products of pyrolysis of the solid carbonaceous material;

(iii) discharging the particulate source of heat over said weir and downwardly into said mixing region at a rate sufficient to maintain said pyrolysis zone at the pyrolysis temperature;

(iv) injecting the solid carbonaceous material feed stream and carrier gas from the solids feed inlet into the mixing region to form a resultant turbulent mixture of the particulate source of heat, the solid carbonaceous material particles and carrier gas;

(v) passing the resultant turbulent mixture downwardly from said mixing zone to the pyrolysis zone of said pyrolysis reactor to pyrolyze the solid carbonaceous material particles and yield a pyrolysis product stream containing as particulate solids, the particulate source of heat and a carbon containing solid residue of pyrolysis of the solid carbonaceous material particles, and a vapor mixture of carrier gas and pyrolytic vapors comprising volatilized hydrocarbons and tars;

(c) passing the pyrolysis product stream from said pyrolysis reactor to a separation zone to separate at least the bulk of the particulate solids from the vapor mixture;

(d) forming the particulate source of heat by subjecting carbon in the separated particulate solids to oxidation in at least one oxidation stage in the presence of an amount of free oxygen at least sufficient to raise the particulate solids to a temperature sufficient for feed to the substantially vertically oriented chamber, wherein said at least one oxidation stage comprises a cyclone oxidation-separation zone so that the bulk of the particulate source of heat is separated from the gases present in the cyclone oxidation-separation stage to form the feed to the substantially vertically oriented chamber; and (e) recovering hydrocarbon values from the vapor mixture by progressively cooling the vapor mixture in a plurality of gas-liquid cooling-condensation stages in series, each stage having a liquid coolant, a vapor feed, a vapor effluent, and liquid condensate, the liquid coolant of each stage including the condensate of the stage, the coolant of each stage being below the temperature of the vapor feed to the stage and vapor effluent of the stage, the condensate of each stage being progressively lower in average boiling point and tar content.

27. A process as claimed in claim 26 in which the pyrolysis temperature is from about 600° to about 2000° F.

28. A process as claimed in claim 26 in which the pyrolysis temperature is from about 600° to about 1400° F.

29. A process as claimed in claim 26 in which the pyrolysis temperature is from about 900° to about 1400° F.

30. A process as claimed in claim 26 in which a substantial portion of the particles of the solid carbonaceous material are particles in the range from about 10 to about 1000 microns in diameter.

31. A process as claimed in claim 26 in which the solid carbonaceous material is an agglomerative coal and a substantial portion of the particulate solid carbonaceous material is of a particle size less than about 250 microns in diameter.

32. A process as claimed in claim 26 in which the particulate solid carbonaceous material is an agglomerative coal, and a substantial portion of the particulate solid carbonaceous material is of a particle size in the range from about 10 to about 250 microns in diameter.

33. A process as claimed in claim 26 in which the resultant turbulent mixture has a solids content ranging from about 0.1 to about 10% by volume based on the total volume of the resultant turbulent mixture and a weight ratio of the particulate source of heat to solid carbonaceous material feed of from about 2 to about 20:1.

34. A process as claimed in claim 26 having a pyrolysis time of less than about 5 seconds.

35. A continuous process for recovery of values contained in solid carbonaceous materials which comprises the steps of:

(a) providing a feed stream containing a particulate solid carbonaceous material, a substantial portion of the particulate solid carbonaceous material being of a particle size less than about 1000 microns in diameter;

(b) subjecting the particulate solid carbonaceous material to flash pyrolysis by continuously:

(i) transporting the particulate solid carbonaceous material feed stream contained in a carrier gas which is substantially nondeleteriously reactive with respect to the products of pyrolysis of the particulate solid carbonaceous material to a solids feed inlet of a substantially vertically oriented, descending flow pyrolysis reactor having a substantially vertically oriented pyrolysis zone operated at a pyrolysis temperature above about 600° F.;

(ii) feeding a particulate source of heat at a temperature above the pyrolysis temperature to a substantially vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate source of heat in said chamber being maintained in a fluidized state by the flow therewith of an aerating gas substantially nondeleteriously reactive with respect to the products of pyrolysis of the particulate solid carbonaceous material;

(iii) discharging the particulate source of heat over said weir and downwardly into said mixing region at a rate sufficient to maintain said pyrolysis zone at the pyrolysis temperature;

(iv) injecting the particulate solid carbonaceous material feed stream and carrier gas from the solids feed inlet into the mixing region to form a resultant turbulent mixture of the particulate source of heat, the particulate solid carbonaceous material and carrier gas;

(v) passing the resultant turbulent mixture downwardly from said mixing zone to the pyrolysis zone of said pyrolysis reactor to pyrolyze the particulate solid carbonaceous material and yield a pyrolysis product stream containing as particulate solids, the particulate source of heat and a particulate carbon containing solid residue of pyrolysis of the particulate solid carbonaceous material, and a vapor mixture of carrier gas and pyrolytic vapors comprising volatilized hydrocarbons including tars;

(c) passing the pyrolysis product stream from said pyrolysis reactor to a separation zone to separate at least the bulk of the particulate solids from the vapor mixture; and (d) forming the particulate source of heat by subjecting carbon in the separated particulate solids to oxidation by:

(i) transporting the separated particulate solids from the separation zone to a cyclone oxidation-separation stage with a transport gas containing free oxygen with resultant carbon monoxide formation from the carbon in the particulate solids; and (ii) combining the transported particulate solids, carbon monoxide and transport gas in the cyclone oxidation-separation stage with a source of free oxygen in an amount at least equal to 50 mole percent of the carbon monoxide entering the cyclone oxidation-separation stage, the total free oxygen in the transport gas and combined in the oxidation-separation stage being sufficient to raise the solids to the temperature required for introduction to the vertically oriented chamber, while simultaneously separating the gaseous products of oxidation from the heated particulate source of heat, the residence time in said cyclone oxidation-separation stage being less than about 5 seconds; and (e) recovering hydrocarbon values from the vapor mixture by progressively cooling the vapor mixture in a plurality of gas-liquid cooling-condensation stages in series, each stage having a liquid coolant, a vapor feed, a vapor effluent, and liquid condensate, the liquid coolant of each stage including the condensate of the stage, the coolant of each stage being below the temperature of the vapor feed to the stage and vapor effluent of the stage, the condensate of each stage being progressively lower in average boiling point and tar content.

36. A process as claimed in claim 35 in which the residence time in said cyclone oxidation-separation stage is from about 0.1 to about 3 seconds.

37. A process as claimed in claim 35 in which the pyrolysis temperature is from about 600° to about 2000° F.

38. A process as claimed in claim 35 in which the pyrolysis temperature is from about 600° to about 1400° F.

39. A process as claimed in claim 35 in which the pyrolysis temperature is from about 900° to about 1400° F.

40. A process as claimed in claim 35 in which a substantial portion of the particulate solid carbonaceous material are particles in the range from about 10 to about 1000 microns in diameter.

41. A process as claimed in claim 35 in which the solid carbonaceous material is an agglomerative coal and a substantial portion of the particulate solid carbonaceous material is of a particle size less than about 250 microns in diameter.

42. A process as claimed in claim 35 in which the particulate solid carbonaceous material is an agglomerative coal, and a substantial portion of the particulate solid carbonaceous material is of a particle size in the range from about 10 to about 250 microns in diameter.

43. A process as claimed in claim 35 in which the resultant turbulent mixture has a solids content ranging from about 0.1 to about 10% by volume based on the total volume of the resultant turbulent mixture and a weight ratio of the particulate source of heat to solid carbonaceous material feed of from about 2 to about 20:1.

44. A process as claimed in claim 35 having a pyrolysis time of less than about 5 seconds.

* * * * *